US006301997B1

(12) United States Patent
Welte

(10) Patent No.: US 6,301,997 B1
(45) Date of Patent: Oct. 16, 2001

(54) POSITIONING DEVICE FOR POWER-DRIVEN FASTENER

(76) Inventor: Gregory A. Welte, 806 N. County Rd. 700 West, Frankfort, IN (US) 46041

( * ) Notice: Subject to any disclaimer, the term of this patent is extended or adjusted under 35 U.S.C. 154(b) by 0 days.

(21) Appl. No.: 09/659,200

(22) Filed: Sep. 11, 2000

(51) Int. Cl.[7] ..... B25B 13/00

(52) U.S. Cl. ..... 81/54; 81/52; 33/286; 33/263

(58) Field of Search ..... 81/52, 54, 57.24, 81/57.4, 180.1; 33/DIG. 21, 227, 263, 276, 286

(56) References Cited

U.S. PATENT DOCUMENTS

| | | | | |
|---|---|---|---|---|
| Re. 36,257 | * | 7/1999 | Thomson | 33/1 G |
| 3,906,640 | * | 9/1975 | Sosa | 33/263 |
| 3,946,493 | * | 3/1976 | Torres | 33/334 |
| 3,970,391 | * | 7/1976 | Johnson et al. | 356/152 |
| 4,222,175 | * | 9/1980 | Bernicky | 33/263 |
| 4,383,373 | * | 5/1983 | Couturier | 33/286 |
| 5,052,112 | * | 10/1991 | MacDonald | 33/263 |
| 5,782,003 | * | 7/1998 | Bozzo | 33/291 |

* cited by examiner

*Primary Examiner*—James G. Smith
*Assistant Examiner*—Hadi Shakeri

(57) ABSTRACT

A positioning device for a power tool. A tool, such as a drywall screw gun, is equipped with a projector which projects two light rays, which form a "V." The axis of a screw driven by the gun lies in the plane of the "V," as by bisecting the "V." If the two rays are positioned so that they illuminate a framing member, such as a 2×4 stud, then this axis will intersect that stud. In effect, (1) the stud becomes the horizontal base of a triangle, (2) the legs of the "V" become the sides, and (3) the axis becomes the altitude. The altitude (axis) necessarily intersects the base (stud). This intersection occurs whether or not a sheet of material, such as drywall, covers part of the stud, provided extremeties of the stud are exposed for the illumination described above. Thus, the location of the concealed part of the stud can be determined, despite the fact that a sheet of material obscures that part.

9 Claims, 43 Drawing Sheets

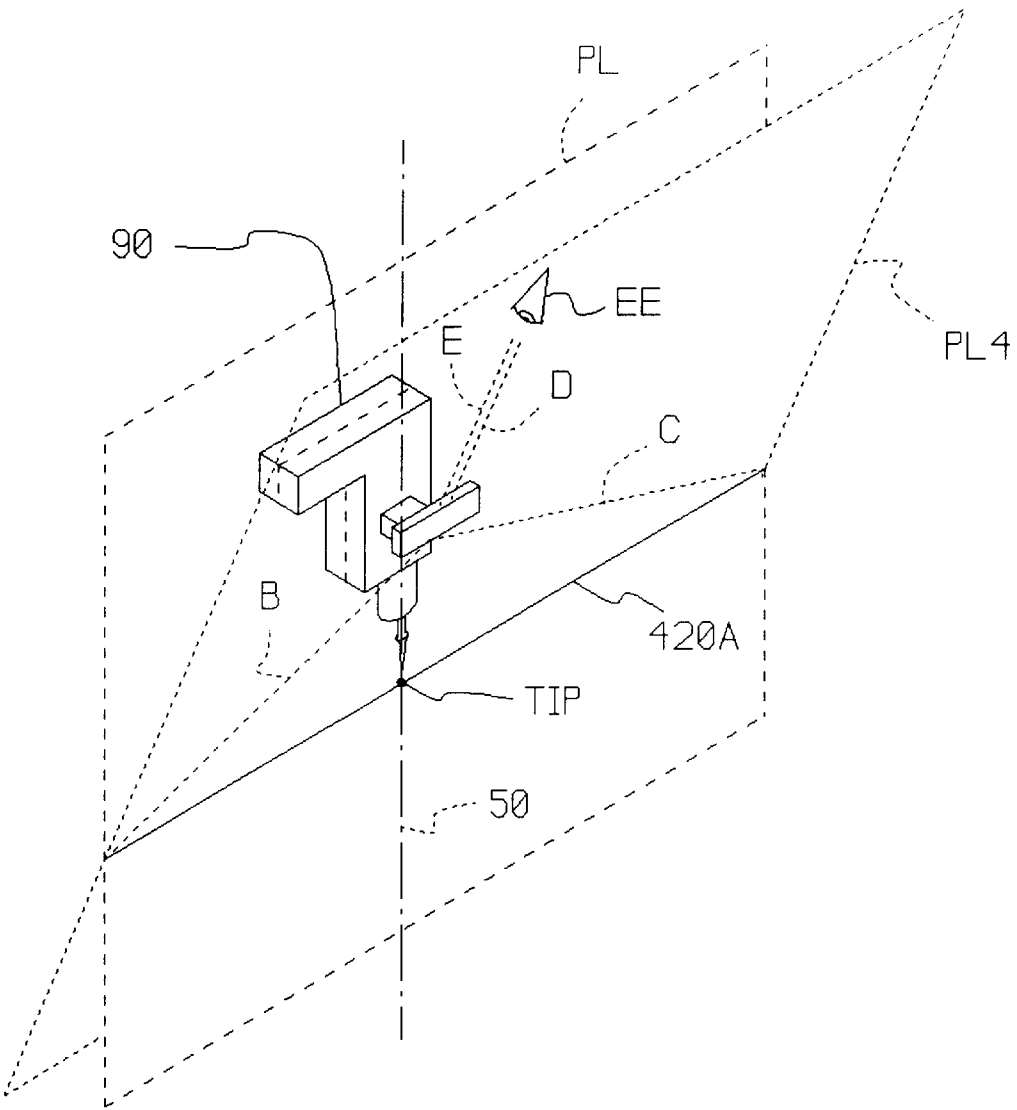
FIG 30
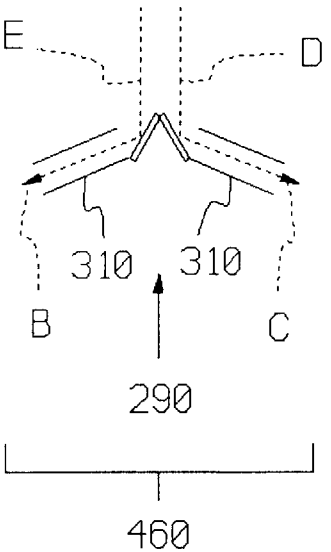

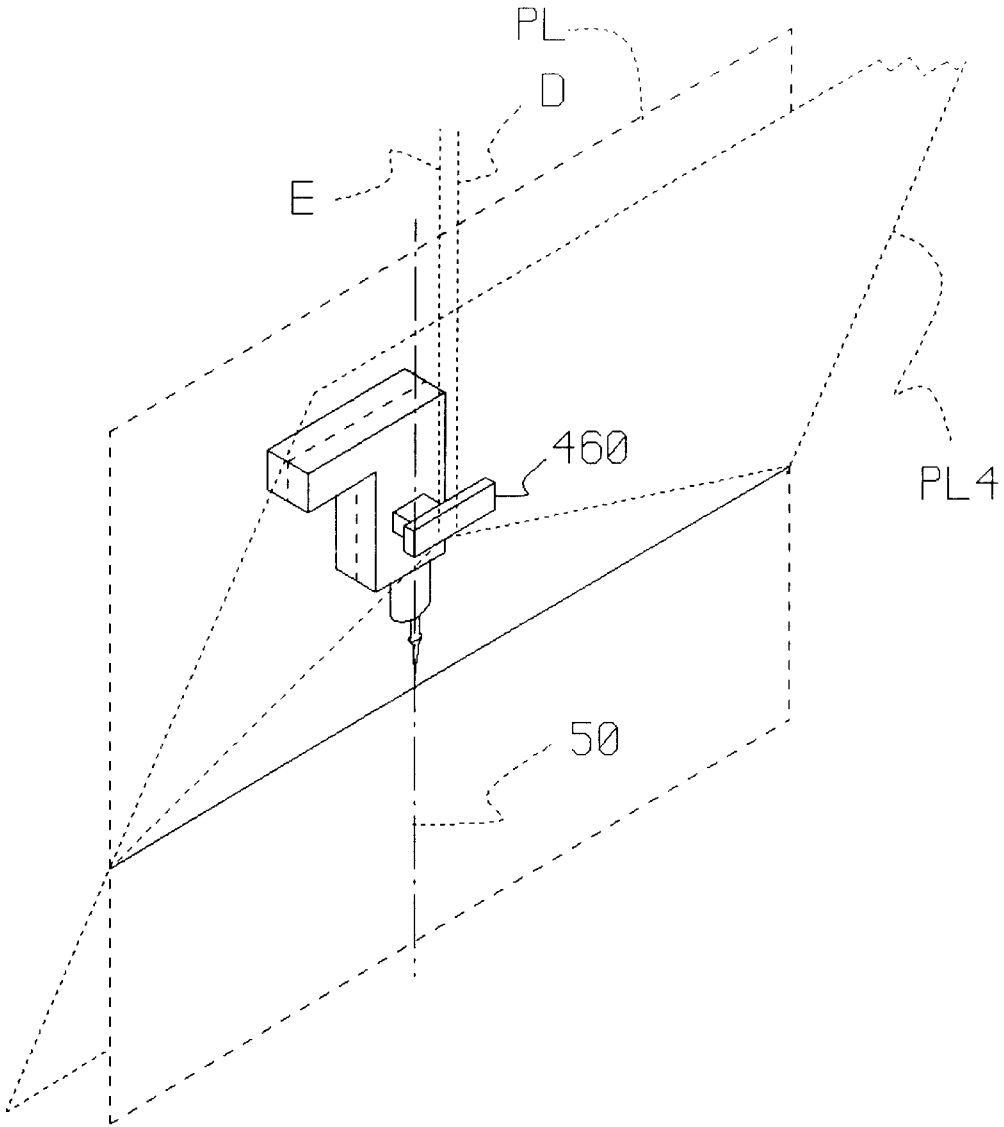
FIG 31
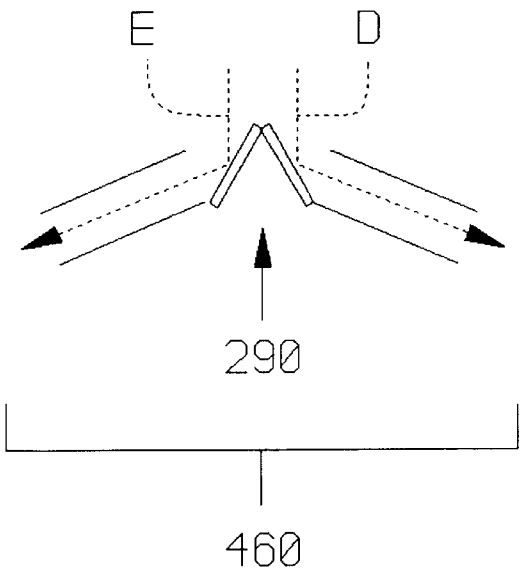

290
P5
E
PL4
$E_{IN}$

AR
AX
P5
290

E
P5

BASE
CONE
APEX
AX

POSITIONING DEVICE FOR POWER-DRIVEN FASTENER

When a drywall screw gun is positioned in the center of a sheet of drywall, that part of a 2×4 stud located behind the sheet, and to which the sheet is to be attached, is not visible. The invention locates this invisible part, and informs the operator where to place the screw gun.

BACKGROUND OF THE INVENTION

FIG. 1 illustrates a sheet 3 of material, such as plywood or gypsum wallboard. Such a sheet 3 is generally installed over framing members 6, which can take the form of joists, studs, or rafters. One installation method utilizes an electric drill, which drives threaded screws through the sheet, and into the framing members 6.

However, when a screw is to be installed a distance from the edge 9 of the sheet, such as at point 12 along central longitudinal axis CAX, it is difficult to locate the framing member 6, because that member is not visible at point 12. One solution to the problem is to visually estimate the position of the framing member 6, but that approach often results in errors, and produces screws which must be removed because they miss the framing member 6.

Another solution is to snap a chalk line across the sheet 3, which is aligned with the visible parts of the framing member 6, as from points P1 to P2. This solution is effective, but time-consuming.

OBJECTS OF THE INVENTION

An object of the invention is to provide an improved system for driving screws through sheet material into framing members.

SUMMARY OF THE INVENTION

In one form of the invention, an optical projector projects two rays of light outward from a common location, forming a "V." The axis of the fastener extends through the vertex of the "V," and lies in a common plane with the "V." For example, the axis may bisect the angle formed by the "V."

If these rays are properly positioned near two edges of a sheet of drywall, the axis will intersect a framing member located behind, and concealed by, the sheet, thereby indicating where to drive a screw.

BRIEF DESCRIPTION OF THE DRAWINGS

FIG. 30 illustrates another form of the invention.

FIG. 31 illustrates a modification of the device of FIG. 30.

FIG. 56 shows some typical, approximate dimensions.

FIG. 76 illustrates how, even if spots SP are positioned within the error bars EB, the lines D1–D4 can still deviate as indicated from the ideal position.

DETAILED DESCRIPTION OF THE INVENTION

Figure 2:
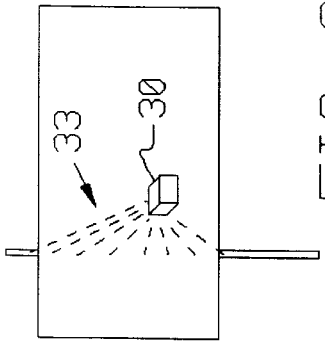

FIG. 2 illustrates a scanner 30, which scans a light beam through successive positions 33. Such scanners are known in the art, and one type of this scanner is used at point-of-sale terminals, to scan bar codes.

Figure 3:
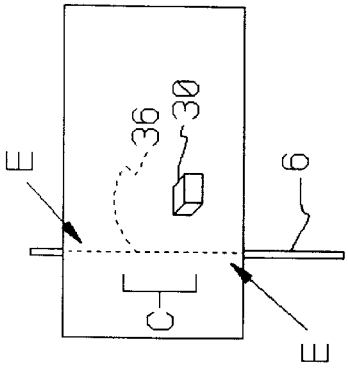
FIGS. 2 and 3 shows a scanner 30, which projects a line 36 of light.

The scanning is done rapidly, so that the spot projected by the light beam appears as a line 36 shown in FIG. 3. The user positions the scanner 30 so that the ends E of line 36 coincide with the framing member 6. The user then utilizes the central part C of line 36 to position a screw (not shown) to be driven into the framing member 6. The line 36 acts as a virtual chalk line.

Figure 4:
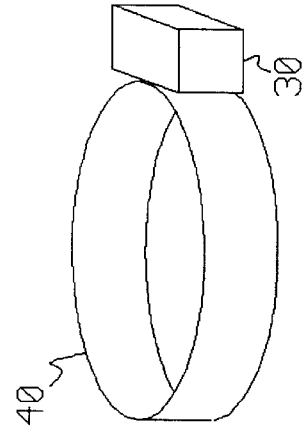
FIG. 4 shows the scanner 30 attached to a band 40.
Figure 5:
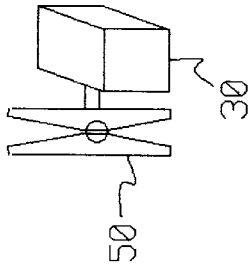
FIG. 5 shows the scanner 30 attached to a clip 50.

The scanner 30 can be fastened to a head band 40 in FIG. 4, and worn about the user's head, or a smaller band 40 can fasten the scanner to the user's hand or forearm. Alternately, a clip 50 can be attached to the scanner 30, as in FIG. 5. The clip attaches to eyeglasses, or safety glasses, which are worn by the user, or to a tool used by the user.

Figure 7:
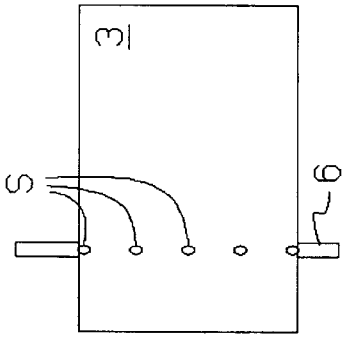
FIG. 7 illustrates the light sources 60 of FIG. 6 projecting spots S onto a sheet 3.
Figure 1:
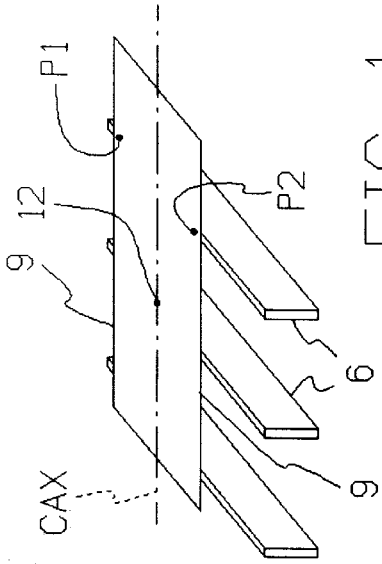
FIG. 1 illustrates a sheet 3 adjacent framing members 6, such as a sheet of plywood 3 positioned over floor joists 6.
Figure 6:
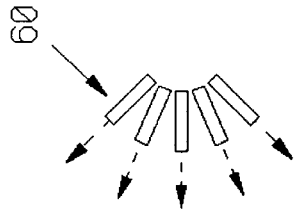
FIG. 6 illustrates several static light sources 60.

FIG. 6 illustrates an alternate type of scanner. Instead of a single projector producing a continuous line, as in FIGS. 2 and 3, several static light sources 60 can be used, to produce a sequence of spots S, as shown in FIG. 7. Since the spots are closely spaced, such as at six inches or a foot apart, it is a simple matter to interpolate between them, and locate a screw over the framing member 6.

Figure 8:
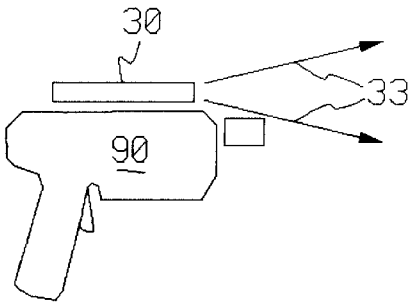
FIG. 8 illustrates the scanner 30 attached to an electric drill 90.

In another form of the invention, the scanner 30 in FIG. 8 is attached to an electric drill 90. It projects rays 33.

Figure 9:
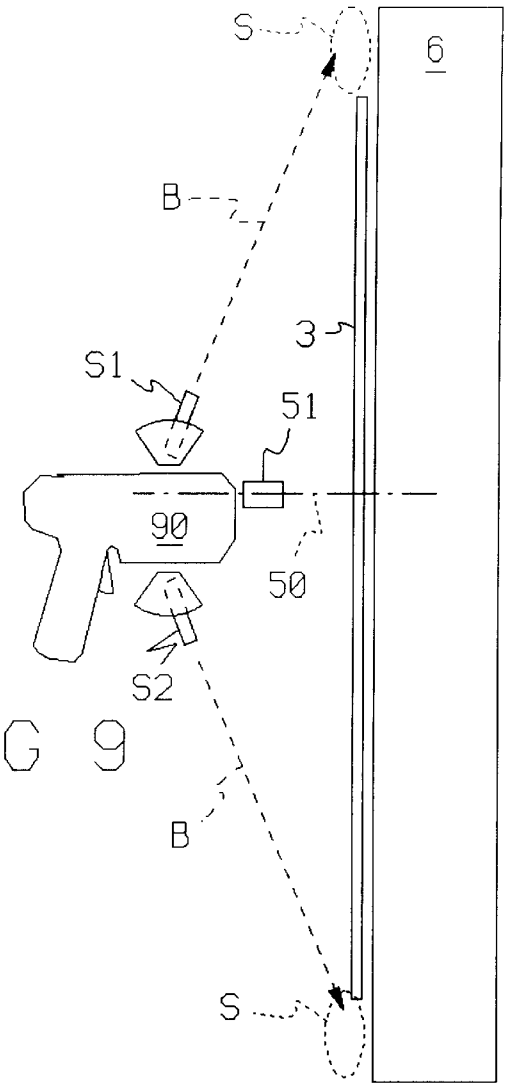
FIG. 9 illustrates one form of the invention.
Figure 10:
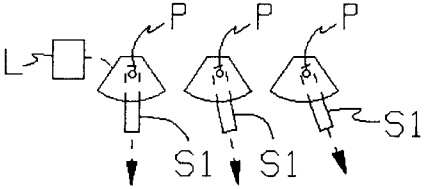
FIG. 10 illustrates a bracket which allows adjustment of projector S1.

In one variation of this approach, two light sources S1 and S2 in FIG. 9 are attached to the drill 90. These sources are adjustable in position, as indicated in FIG. 10. For example, light source S1 is rotatable about pivot P. A locking means L holds source S1 in position.

The system shown in FIG. 9 obeys the following conditions. One, the light beams B and the axis 50 of the drill bit (not shown) lie in the same plane. Two, the light beams B are positioned so that they project spots S onto the framing member 6. Under these conditions, if the drill is held perpendicular to the sheet 3, the drill bit will necessarily lie above the framing member 6, and a screw (not shown) driven by it will enter that member 6 when the drill chuch 51 rotates.

Figure 9A:
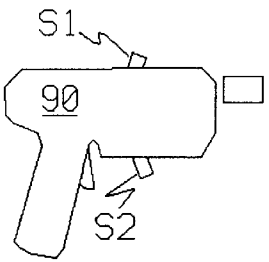
FIG. 9A illustrates another form of the invention.

Preferably, the light sources S1 and S2 are supported by brackets which are an integral part of the housing of the drill 90, as shown in FIG. 9A. They can take the form of laser pointers, or simpler optical projectors.

Figure 11:
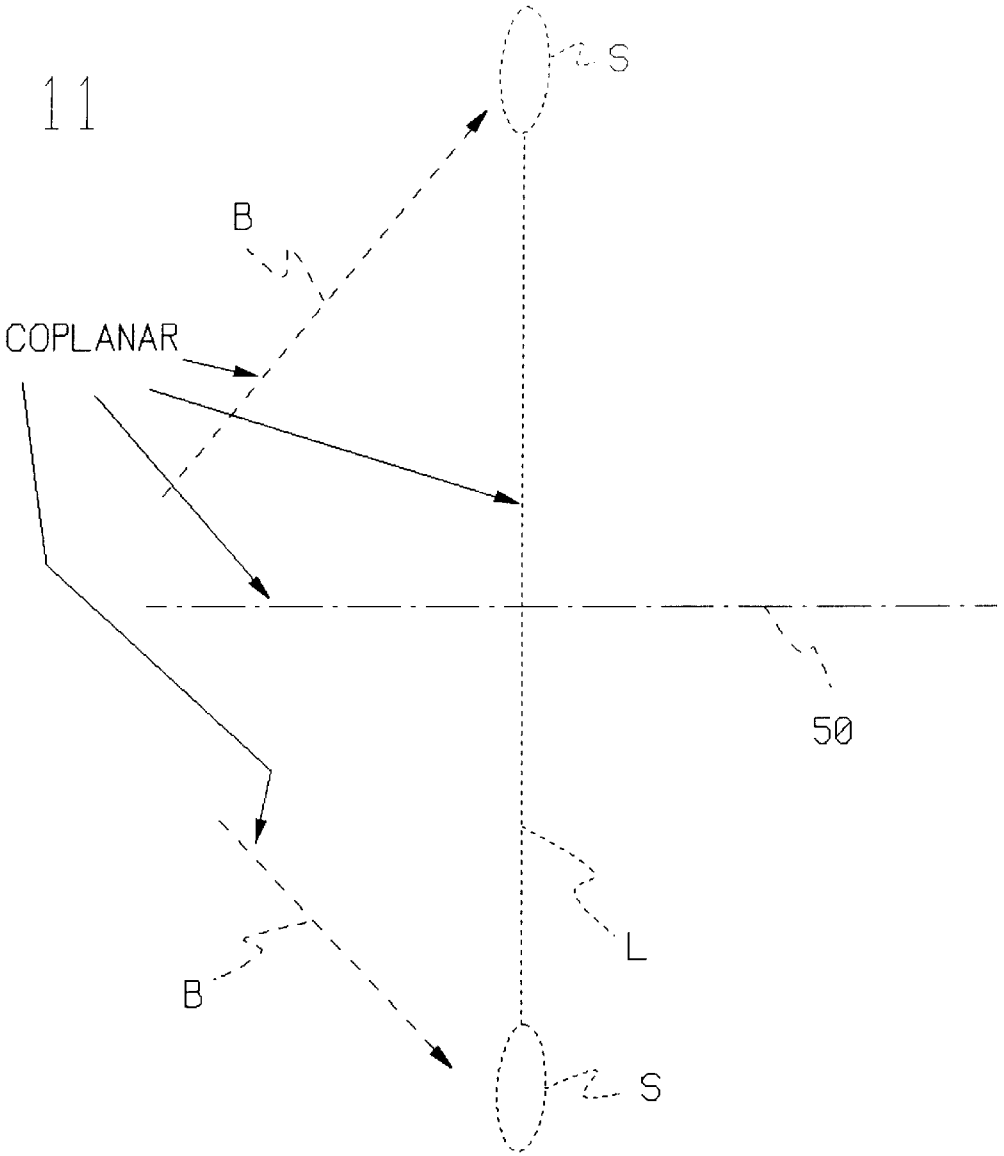
FIG. 11 illustrates geometric elements which explain how the invention functions.

FIG. 11 justifies this operation from a geometric perspective. The beams B1 and B2 assume the legs of a "V," and lie in the same plane (not indicated). They generate spots S. Any line extending between the two spots S will also lie in that plane.

If the spots S are positioned as shown in FIG. 9, a line can be drawn between them which lies above the framing member 6. If, in FIG. 11, the axis 50 of the drill chuck (shown in FIG. 9) lies in that same plane, and lies between the legs of the V in FIG. 11, then that axis 50 will intersect line L.

If line L is positioned above the framing member (not shown), by virtue of spots S being positioned on that member, then axis 50 will intersect the framing member. Thus, a screw (not shown) driven by the drill will enter that framing member.

Figure 12:
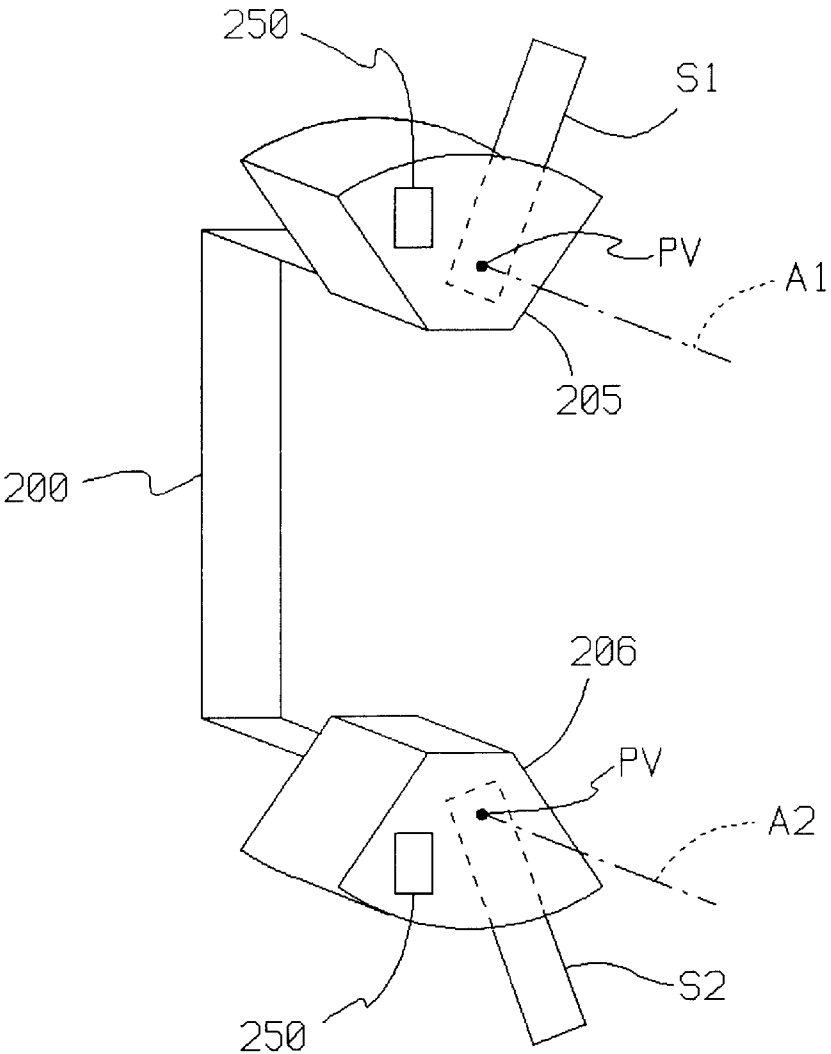
FIGS. 12–18 illustrate other forms of the invention.

FIG. 12 illustrates an accessory for attachment to an existing electric drill. A bracket 200 supports two housings 205 and 206. Each housing supports a pivot pin PV, each of which defines an axis of rotation A1 and A2 for a light source S1 or S2. A clamp, detent, or brake, generally indicated by blocks 250, locks each light source against movement, once properly positioned. The bracket 200 can be attached to an electric drill (not shown) by adhesive tape, or by a more elaborate clamping means.

Figure 13:
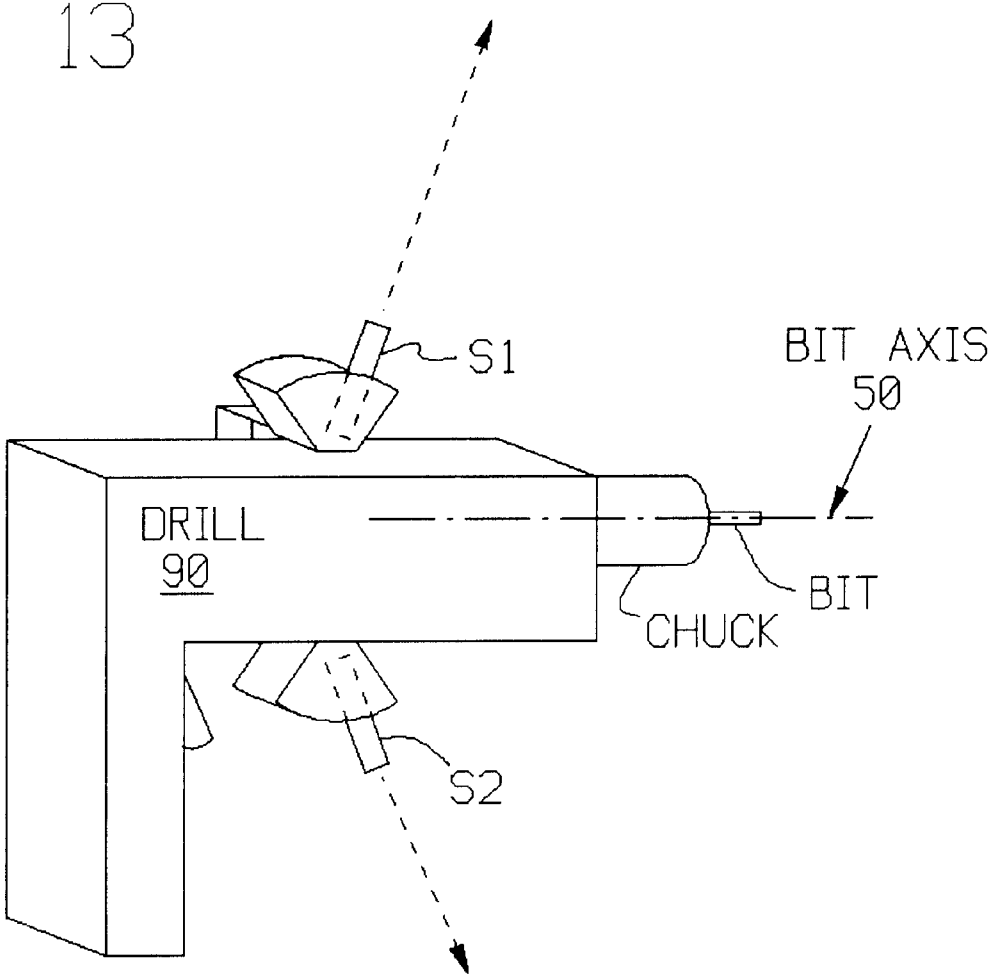

FIG. 13 illustrates the apparatus installed in a drill 90.

ADDITIONAL EMBODIMENT

As background, to illustrate general principles involved in this embodiment, some approaches to positioning the drill will be explained, in three steps.

Figure 19:
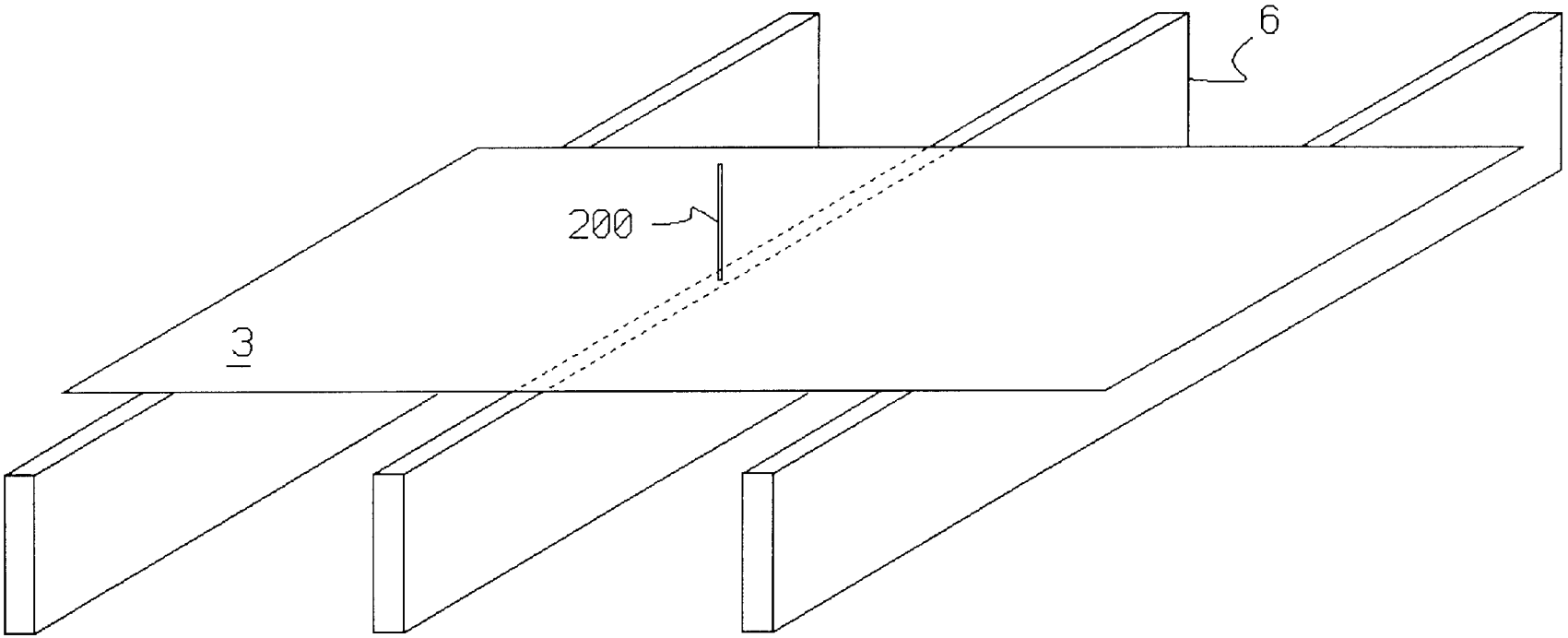
FIG. 19 illustrates a stick 200 positioned on a sheet 3.

As step 1, in FIG. 19, an upright stick 200 is placed onto the sheet 3. The stick 200 represents the screw to be driven. The stick 200 is shown positioned over the framing member 6, but that is coincidental.

Figure 20:
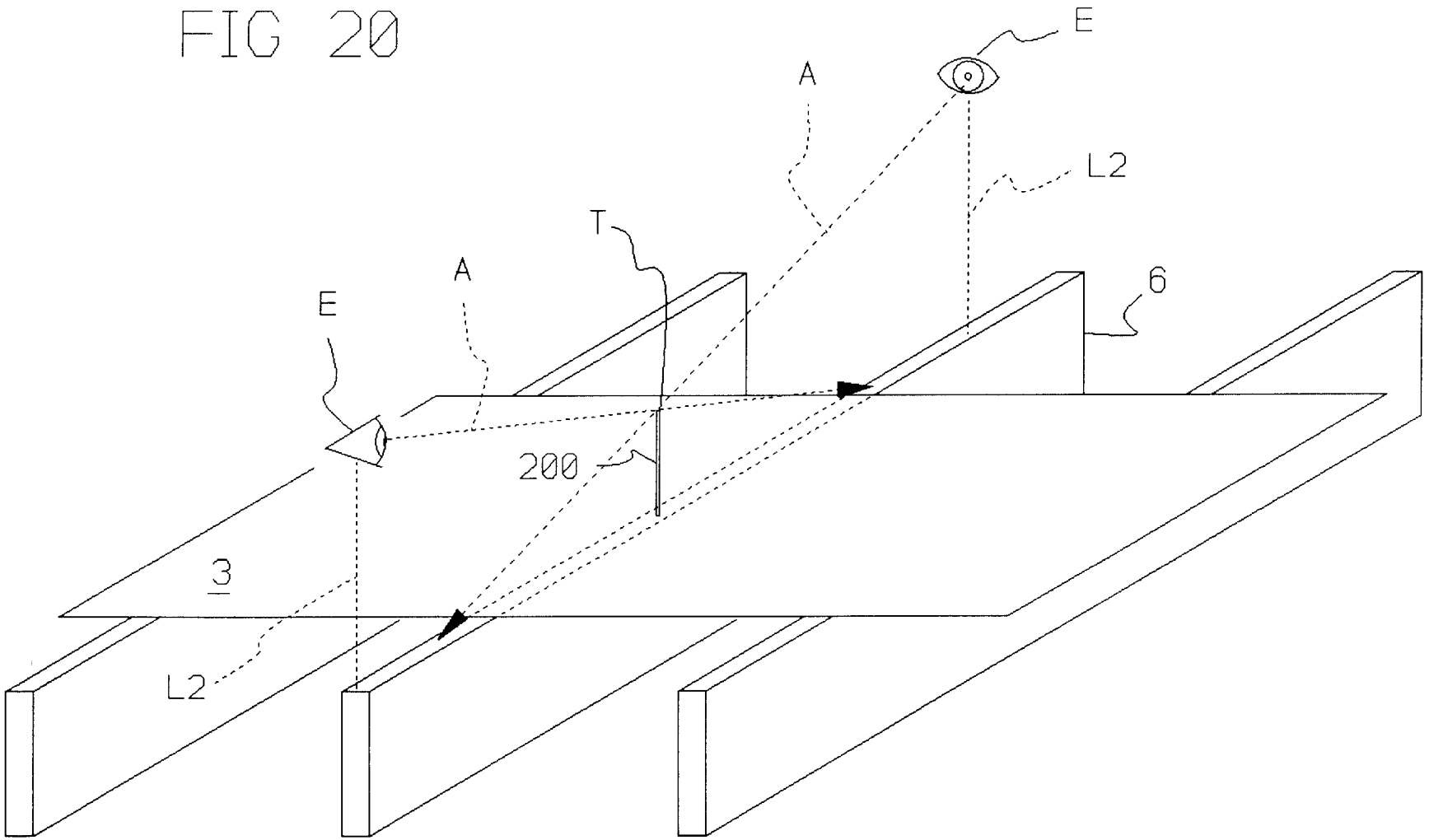
FIG. 20 illustrates two eyes E which sight the tip T of the stick 200, and thereby place it over framing member 6.

As step 2, in FIG. 20, two associates (not shown) position their eyes E over the framing member 6, as indicated by lines L2. Each eye E sights the far section of the framing member, located beyond the opposite end of the sheet 3, as indicated by arrows A.

The associates look for the top T of the stick, and instruct the stick-holder (not shown) to move the stick until the top T coincides with arrow-lines A. When this coincidence occurs, the stick will be positioned over the framing member 6. (Of course, given the assumption that an eye E lies above the framing member, only a single eye E is required to position the stick 200 over the framing member 6. However, in the general case discussed later, this condition is not fulfilled, so the equivalent of two eyes is required, as will be seen.)

Figure 21:
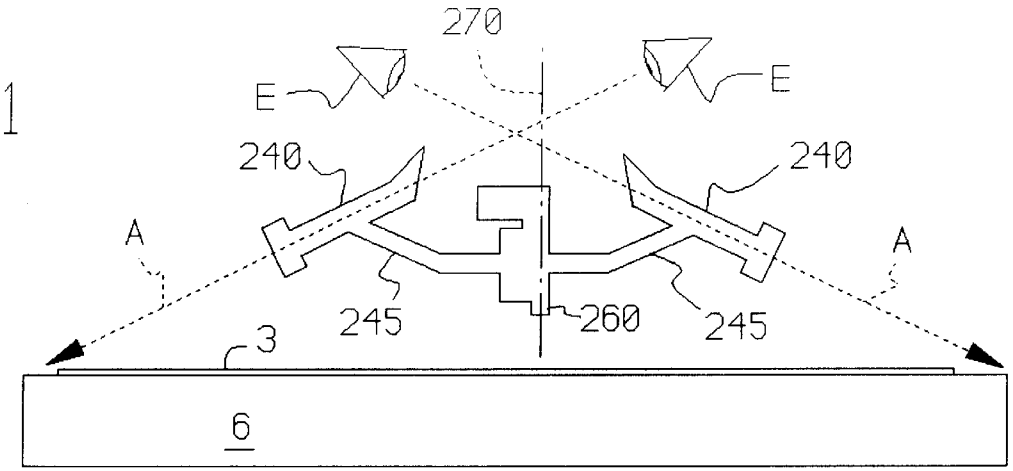
FIG. 21 illustrates telescopes 240 which may assist the process described in connection with FIG. 21.

Continuing this type of approach, in step 3, the associates can sight through optical systems, which, in principle, can be viewed as short-range telescopic rifle scopes 240 in FIG. 21, which are mounted to the drill by arms 245. If the optical axes A are coplanar with the axis 270 of the drill chuck 260, then if the framing member 6 is centered in the cross-hairs (not shown) of each scope 240, the drill axis 270 will intersect the framing member 6.

Figure 22:
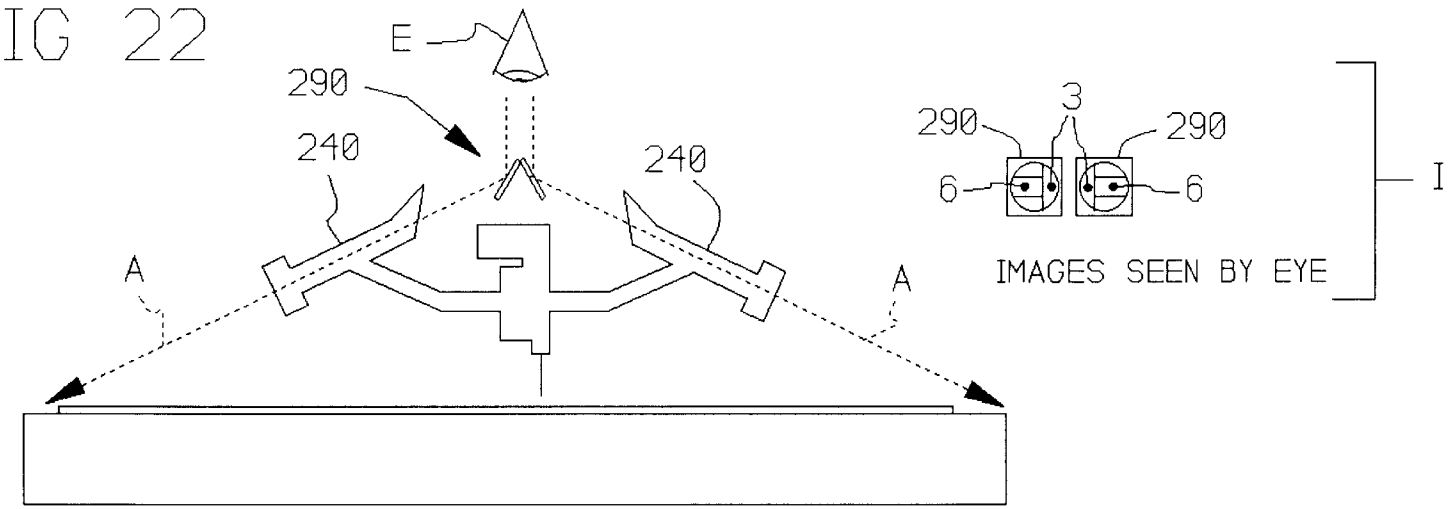
FIG. 22 illustrates how a single eye E can utilize the telescopes, if mirrors 290 are provided.

The principles just illustrated can be implemented as shown in FIG. 22. In FIG. 22, two mirrors direct the sight-lines A to a single eye E. Insert I indicates the images seen in the mirrors 290 when the drill is properly positioned. The framing members 6 are centered in the circular viewing aperture of the scopes 240, and part of the sheet 3 is shown. Cross-hairs of the scopes 240 are not shown.

Figure 24:
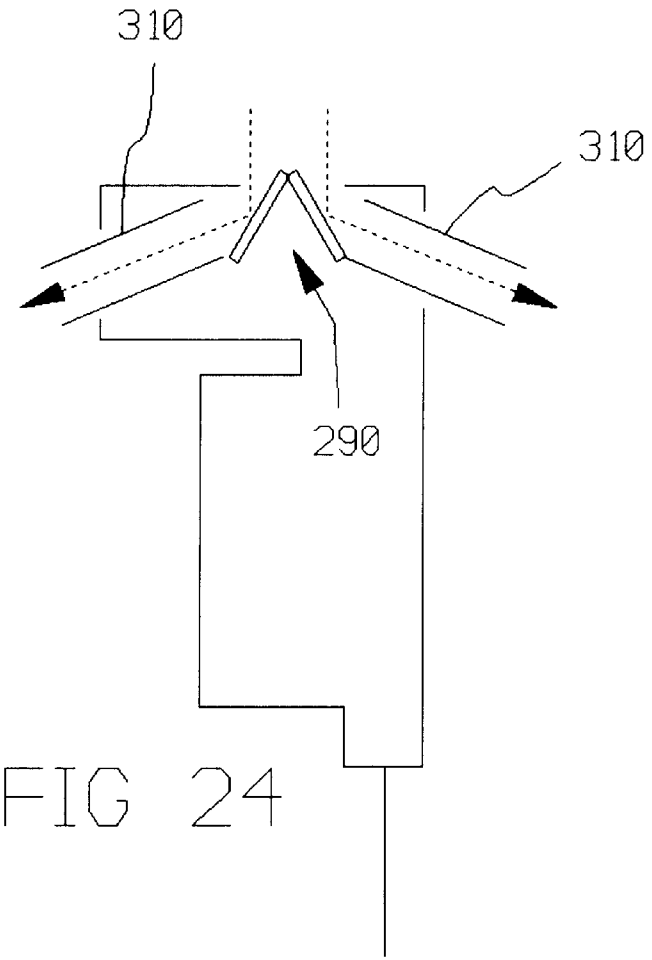
FIGS. 23 and 24 illustrate devices implementing the principles shown in FIGS. 20–22.
Figure 23:
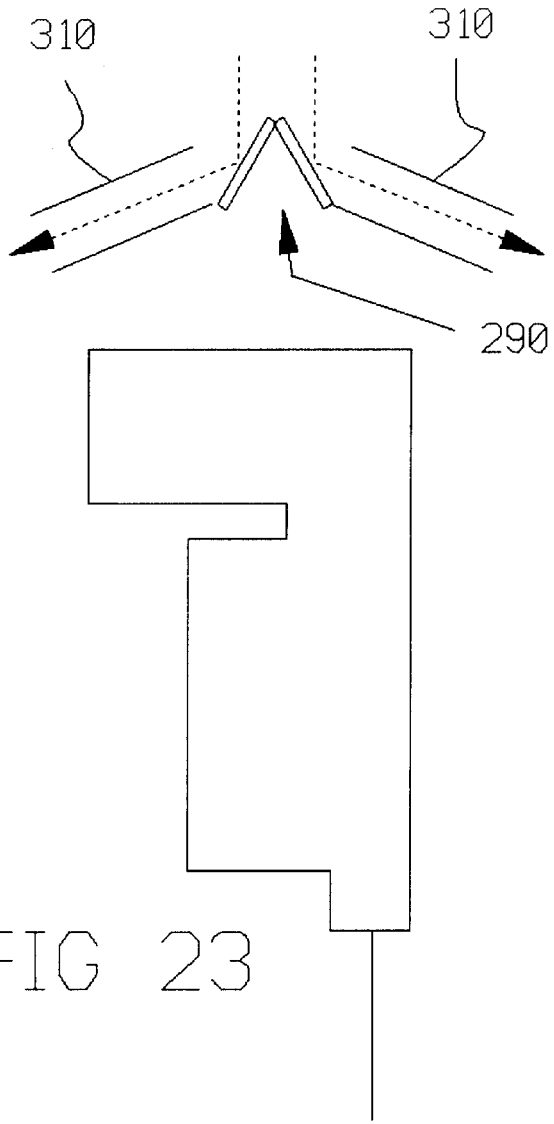

Telescopes are not necessarily required. Hollow tubes 310, shown in cross-section in FIG. 23, can be used. They, and mirrors 290, are fastened to the drill by a support which is not shown. In FIG. 24, the assembly is shown positioned within the body of the drill, specifically, within the handle, and fastened to the drill in that position. Cross-hairs can be provided by stretching threads across one, or more, diamaters of the tubes.

Additional Embodiment

Figure 25:
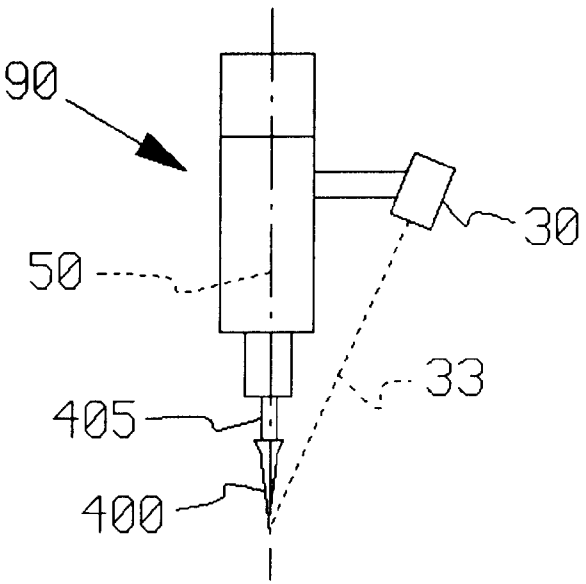

The projector 30 of FIG. 2 can be positioned to the side of the drill 90, as shown in FIG. 25. Drill bit 405 and screw 400 are shown. In this case, the drill axis 50 is not coplanar with the light rays 33.

Figure 26:
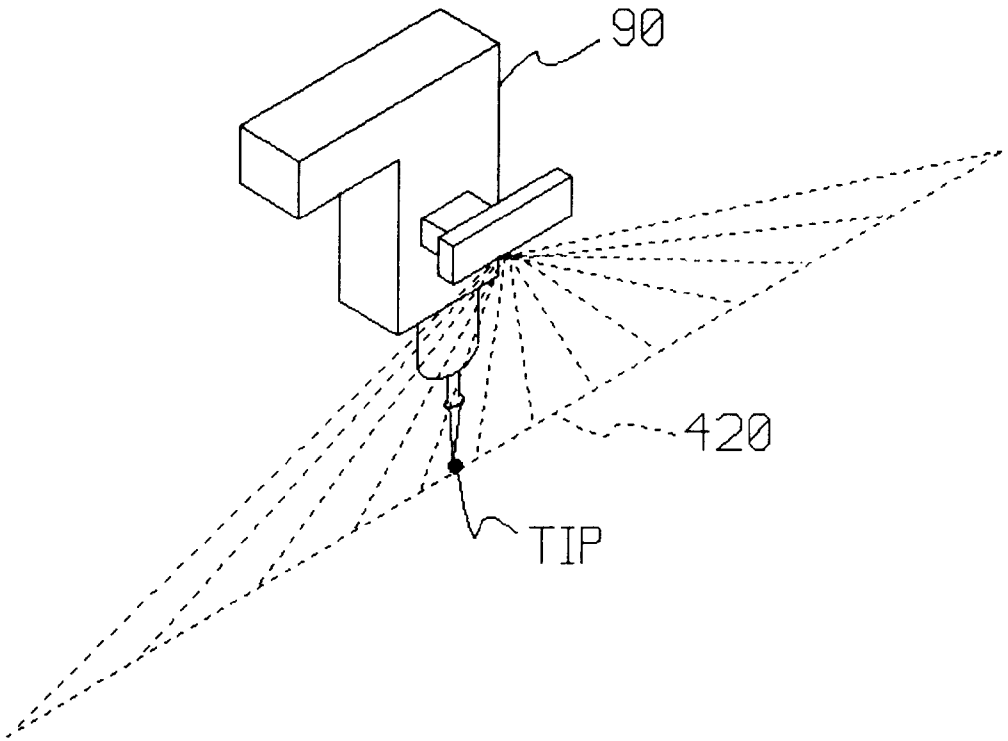
FIGS. 25–27 illustrate additional forms of the invention.

FIG. 26 is a perspective schematic view, showing the line 420 generated by the projector. Preferably, the projector is positioned so that the line 420 crosses the tip of the screw, which is designated TIP.

Figure 27:
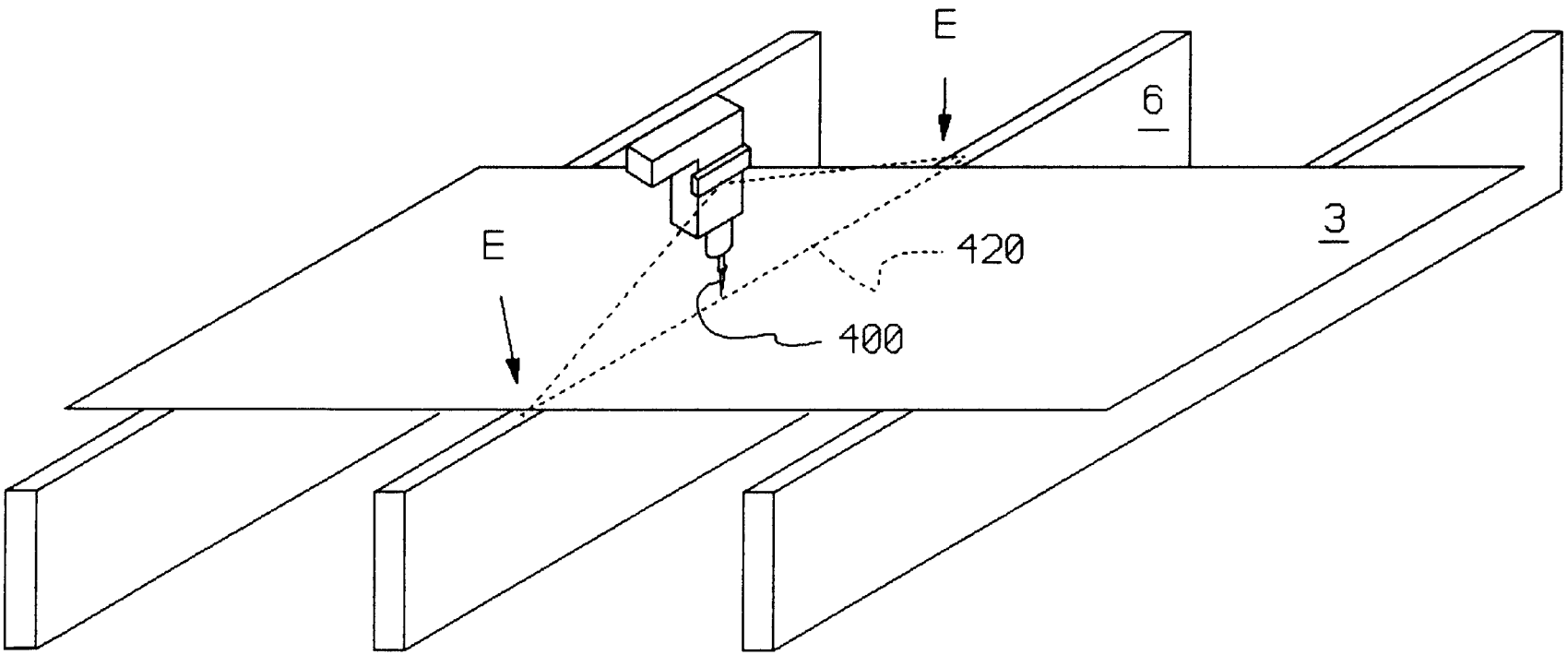

In operation, the line 420 in FIG. 27 is positioned so that its ends E lie above the framing member 6. With this positioning, the screw 400 will necessarily lie above the framing member 6, as FIGS. 28 and 29 explain.

Figure 29:
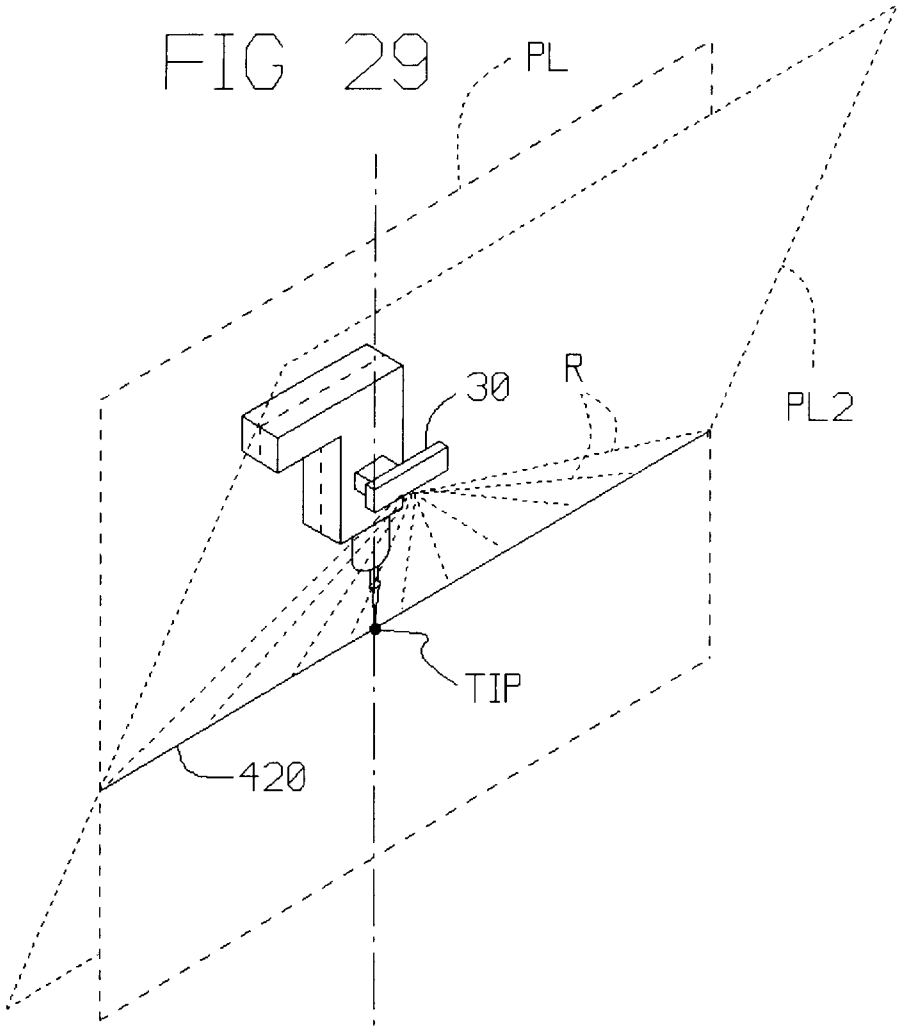
FIGS. 28 and 29 illustrate why the apparatus of FIGS. 25–27 operates successfully.
Figure 28:
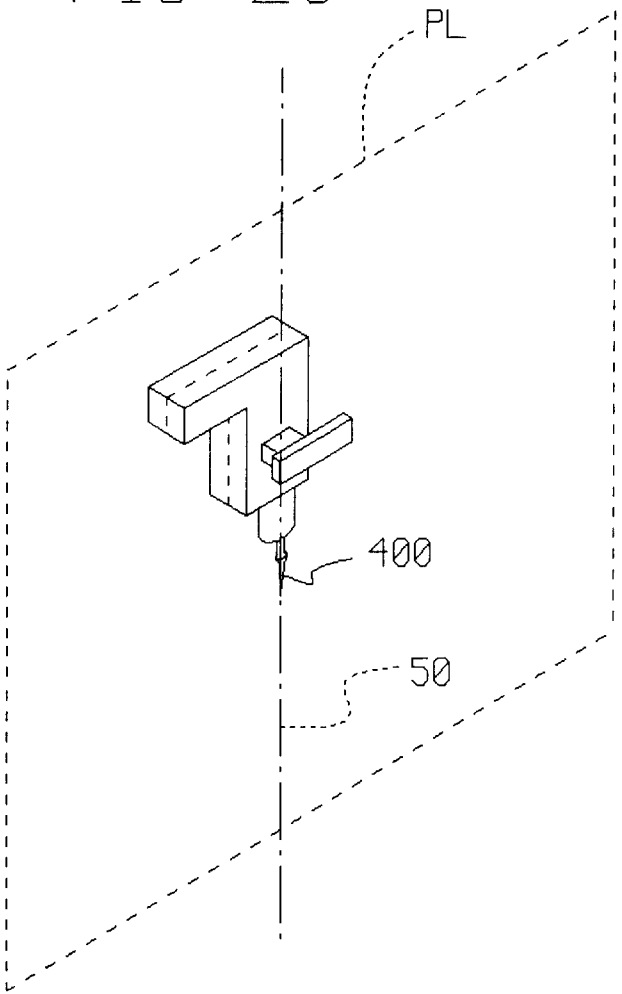

FIG. 28 shows an imaginary plane PL which contains the axis 50 of the screw 400. FIG. 29 superimposes upon this a second plane PL2, which contains the scanned rays R produced by the projector 30. The intersection of those planes produces line 420, because the latter plane PL2, by stipulation, contains the point TIP.

Of course, multiple, scanned rays R are not required. Two single rays, as shown in FIG. 27, will suffice.

The same principles just described can be used in the optical viewing system described earlier. The left side of FIG. 30 illustrates the assembly comprising tubes 310 and mirror 290, labeled as unit 460. This unit 460 is shown installed on the drill, on the right side of the Figure. Optical axes B, C, D, and E on the right side of the Figure correspond to those on the left side.

These axes B, C, D, and E are arranged to lie in the same plane PL4. Further, that plane contains line 420A, which runs through the point TIP. The user's eye EE sights rays E and D, and positions the drill as explained in connection with FIG. 22.

This arrangement requires the operator to position the head to the side of the drill 90, because rays E and D point away from the drill 90. The approach of FIG. 31 eliminates this requirement. The mirrors 290 are rotated so that rays E and D are parallel with axis 50 of the drill 90. The reason why proper rotation moves rays E and D into this parallelism will be explained with reference to FIGS. 32A–32D.

Figures 32A, 32B, 32C, 32D:
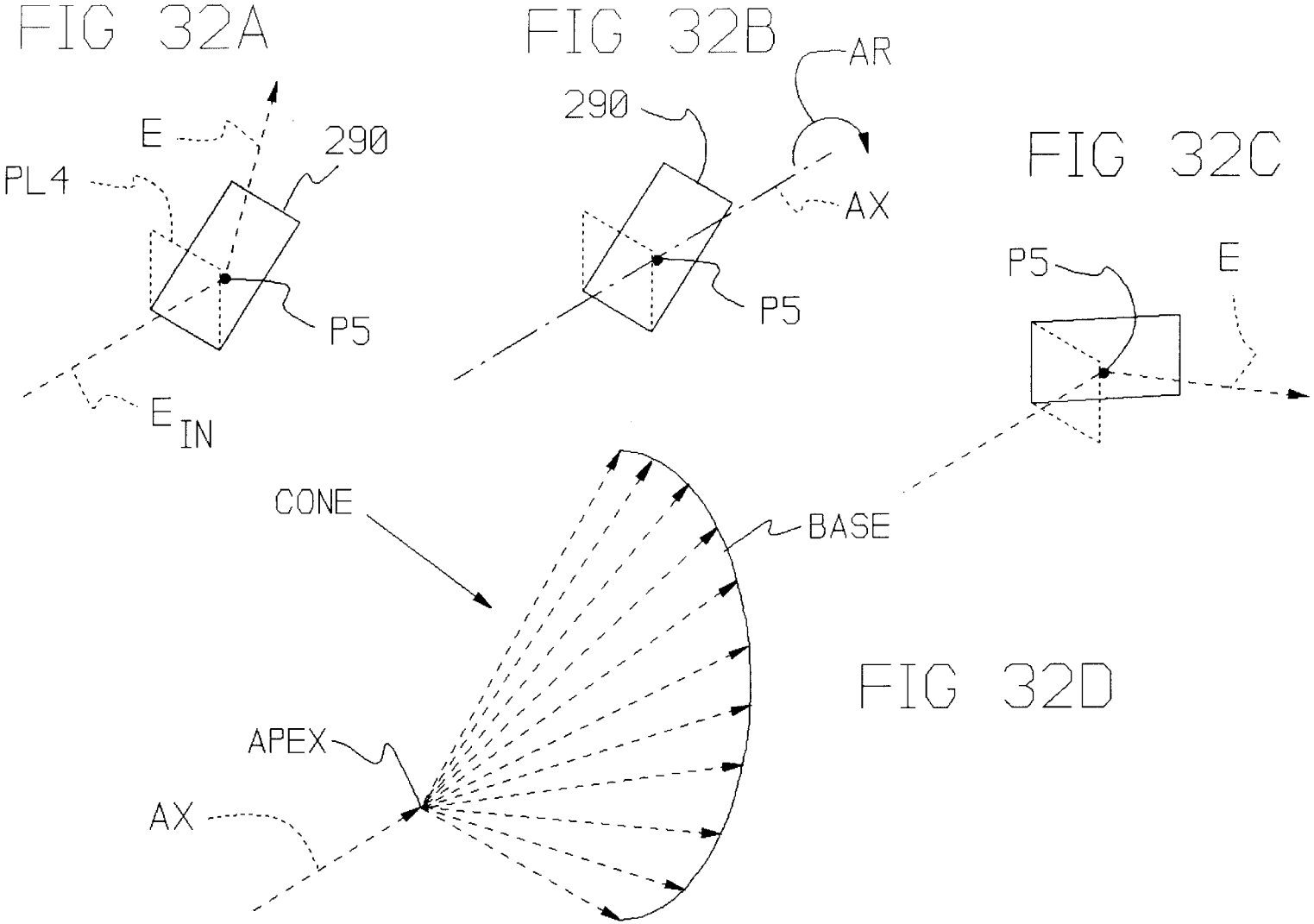
FIGS. 32A, 32B, 32C, and 32D illustrate one mode of achieving the modification shown in FIG. 31.

FIG. 32A shows ray E being reflected by mirror 290. Plane PL4 is a reference plane, and is perpendicular to incoming ray Ein. Point P5 is the reflection point. In FIG. 32B, an axis AX is drawn running through point P5. If mirror 290 is rotated about axis AX, in the direction of arrow AR, to the position shown in FIG. 32C, then ray E will follow the path shown. Ray E has been rotated.

In general, if ray E coincides with the axis AX in FIG. 32D, as the mirror (not shown) rotates, the reflected ray E will be forced to trace the surface of a CONE. The APEX of the cone corresponds to point P5 in FIGS. 32A–32C. The BASE of the CONE is indicated.

This type of rotation allows rays D and E to be shifted to the position shown in FIG. 31.

Additional Embodiments

The preceding discussion considered devices for positioning a drill over a framing member. The present embodiments concern devices for positioning a screw over the framing member, which is then driven by a drill.

Figure 35:
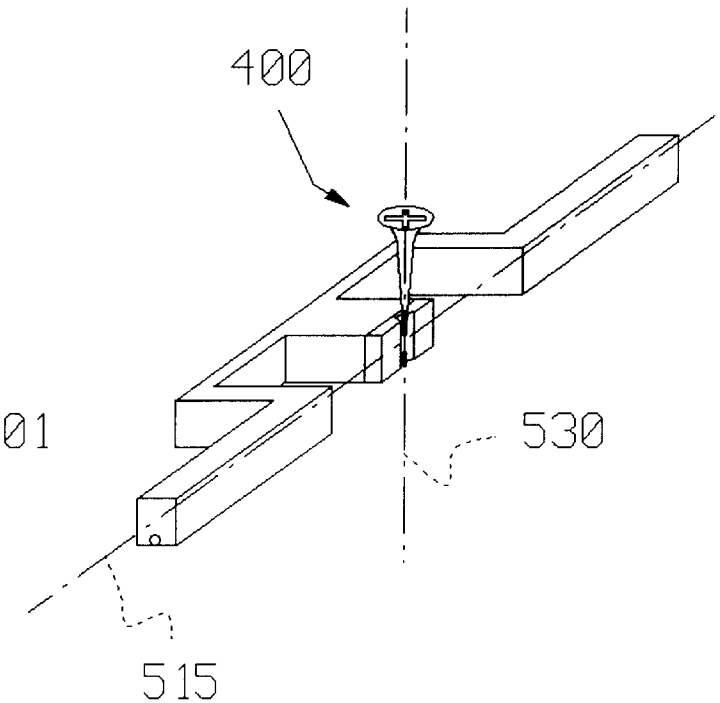
FIGS. 33–35 illustrate another form of the invention.
Figure 34:
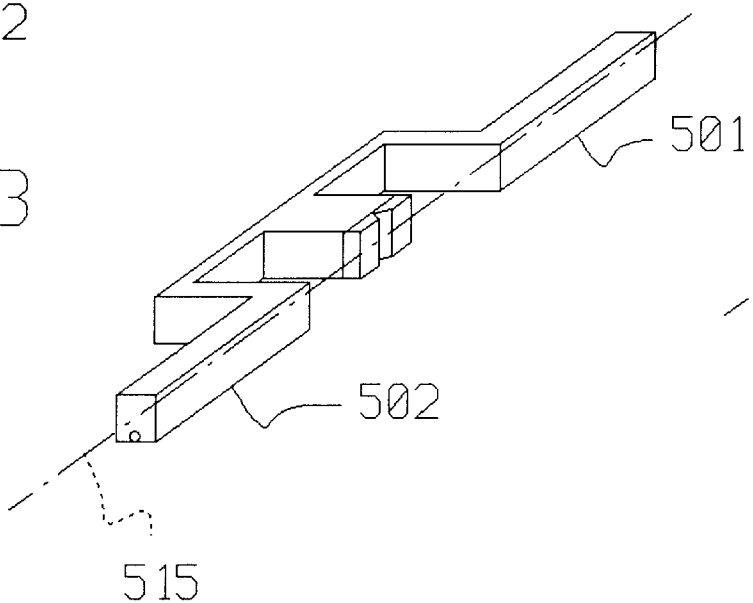
Figure 33:
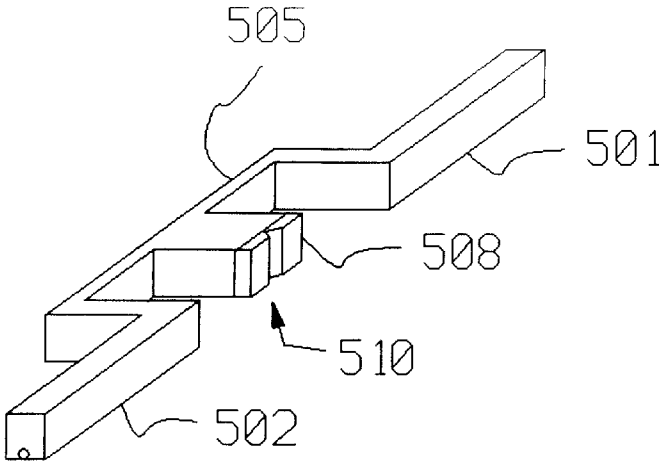

FIG. 33 illustrates two optical projectors 501 and 502, such as commercially available laser pointers. They are connected by a bracket 505, to which is connected a magnet 508, which contains a V-groove 510. The optical projectors are aligned along a common optical axis 515, as shown in FIG. 34. Further, the V-groove 510 provides a screw-positioning station which positions a screw 520 in FIG. 35, so that the axis 530 of the screw intersects the optical axis 515.

Figure 37:
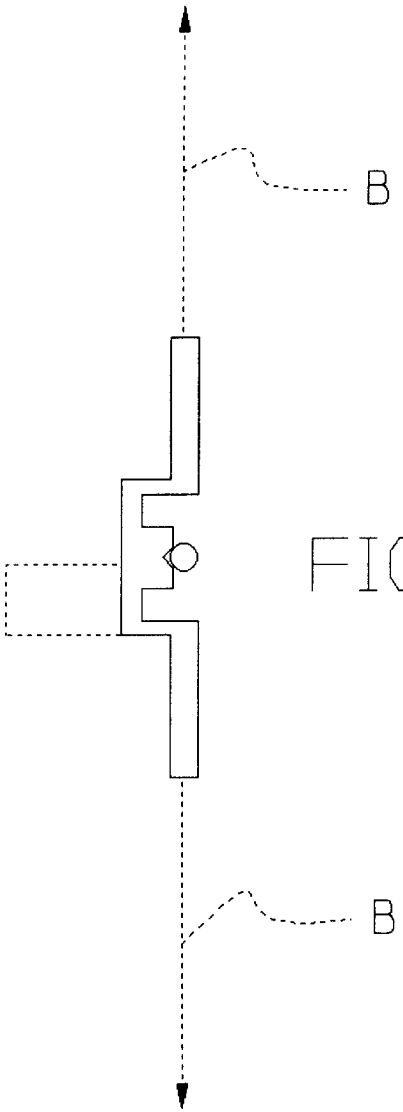
FIGS. 36–38 illustrate operation of the invention of FIGS. 33–35.
Figure 36:
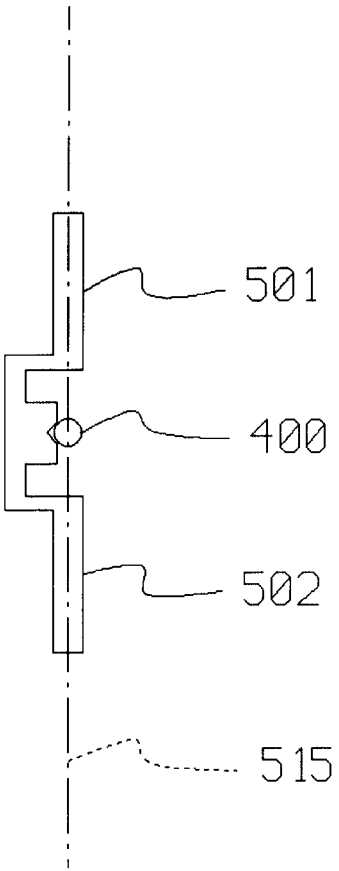

FIG. 36 is a plan view of the device. In use, the device projects two light beams B in FIG. 37. The device is moved until these beams B lie above the framing member 6 in FIG. 38. (Alternately, the device can be moved until beams B lie above screw heads 400 positioned near the edge of the sheet.) Then, a drill (not shown) drills the screw 400 part way. Next, the device is withdrawn from the screw 400, and the screw is driven fully into the framing member 6.

Figures 39, 40:
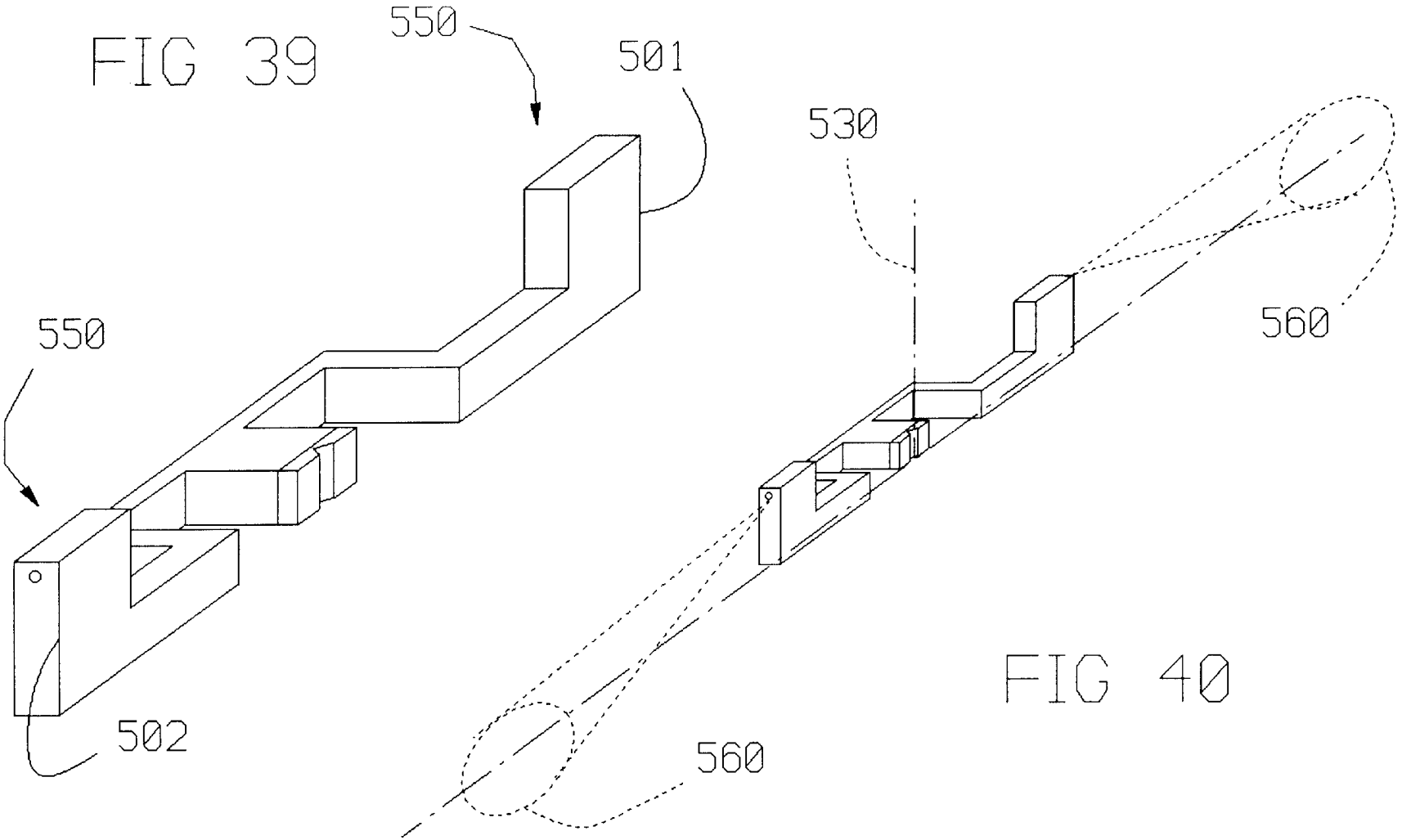
FIGS. 39 and 40 illustrate another form of the invention.
Figure 41:
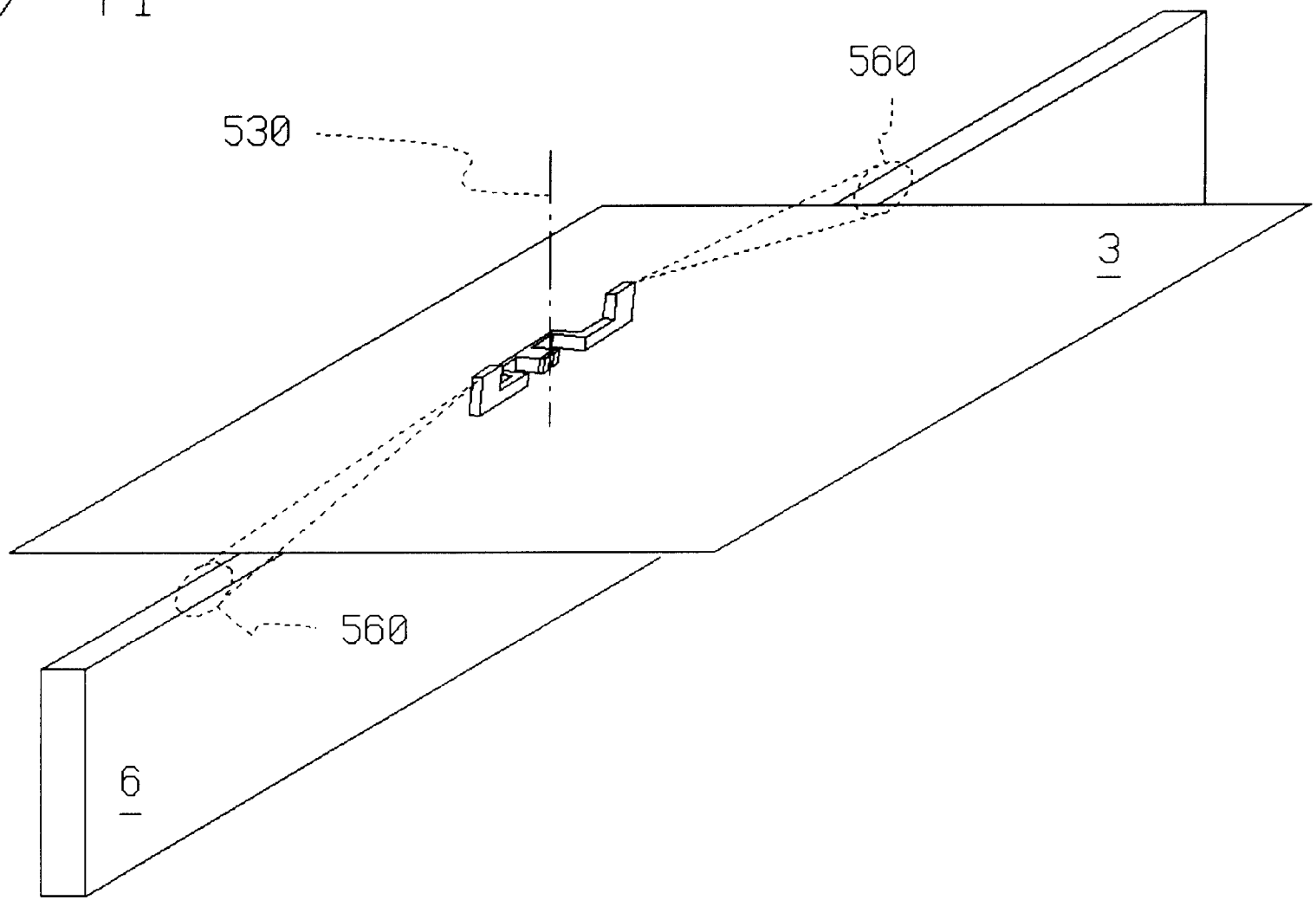
FIG. 41 illustrates operation of the invention of FIGS. 39 and 40.

In the embodiment just described, it was presumed that the light beams grazed the sheet 3, to thereby produce a visible line of light on the sheet. In another embodiment, the projectors are carried by raised brackets 550 in FIG. 39. The raised brackets 550 allow the projectors to generate spots 560 shown in FIG. 40. The operator (not shown) positions the device until it is located as shown in FIG. 41, so that the spots 560 lie atop the framing member 6 (not shown), which assures that the screw axis 530 intersects the framing member 6.

Figure 38:
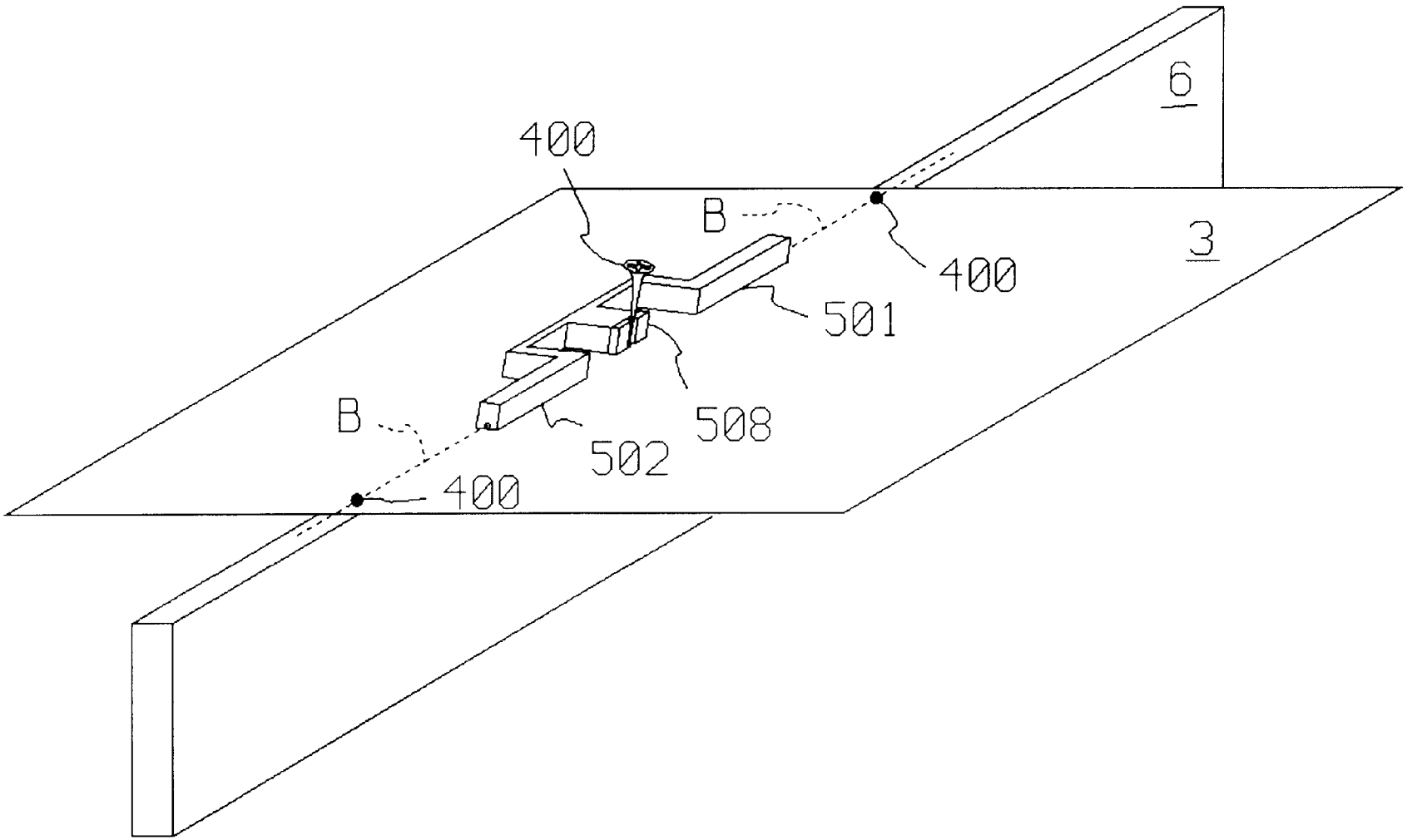
Figure 42:
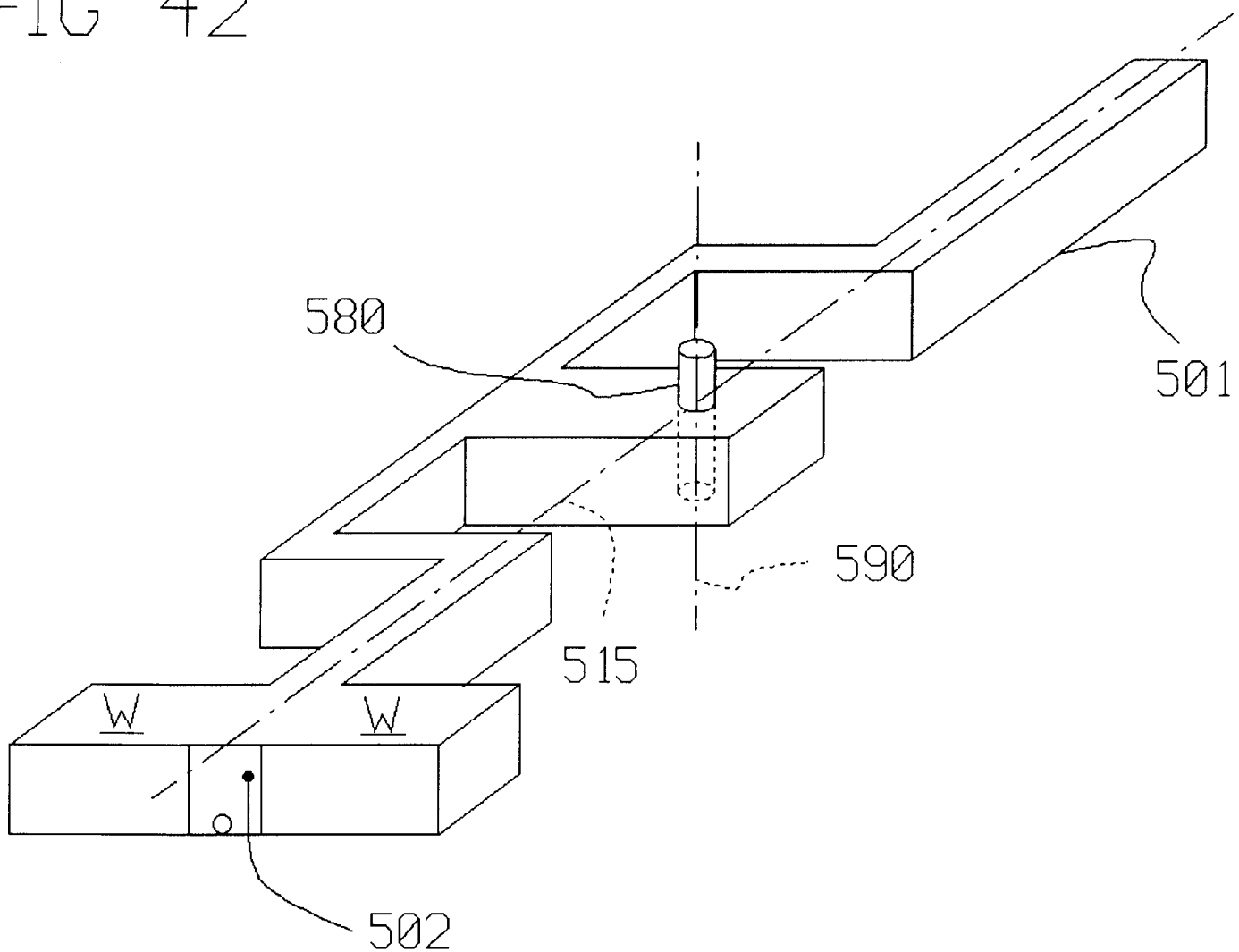
FIG. 42 illustrates another form of the invention.

In another embodiment, a tube 580 in FIG. 42 is constructed, whose axis 590 intersects with optical axis 515. A screw (not shown) is placed into the tube, and the operator (not shown) moves the device until it is positioned as shown in FIGS. 38 or 41. The screw is driven part way, the device is removed, and the screw is then driven fully.

Figure 43:
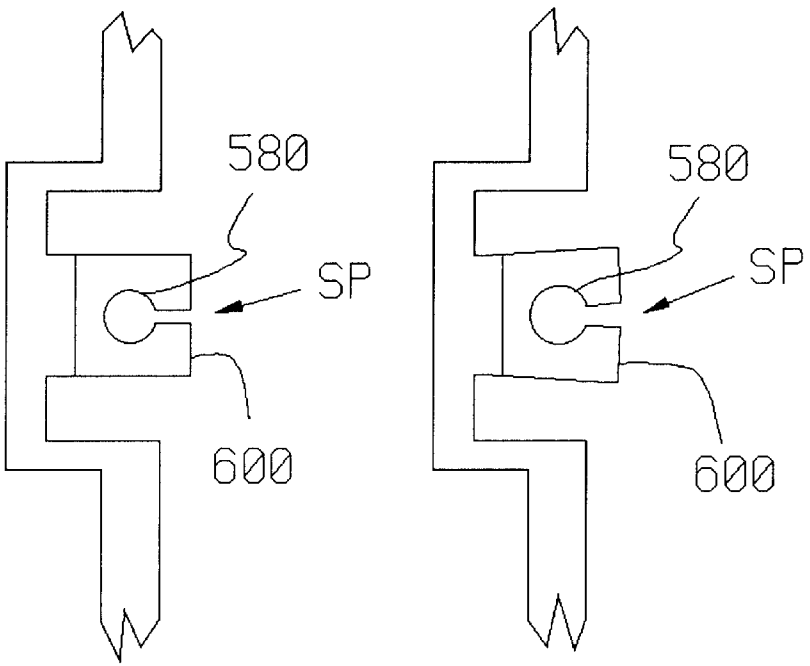
FIGS. 43 and 44 illustrate operation of the invention of FIG. 42.

To allow removal, in FIG. 43, a split SP is constructed near the tube 580. The material surrounding the tube is made flexible, thus allowing the deformation indicated in the Figure.

Figure 44:
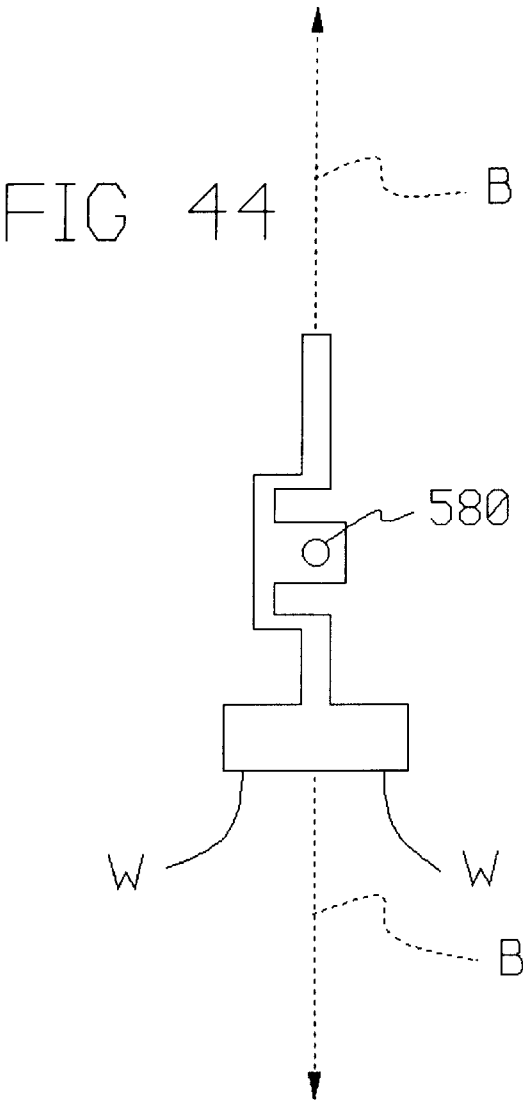

In another form of the invention, weights W are added, as in FIG. 42. When a screw (not shown) is placed in tube 580 in FIG. 44, the device can pivot about the screw. The weights W cause the beams B to assume a vertical position. The operator (not shown) moves the device left and right until the beams B coincide with a framing member, or markers indicating the presence of the framing member. Then the operator drives the screw, as described above.

Figure 14:
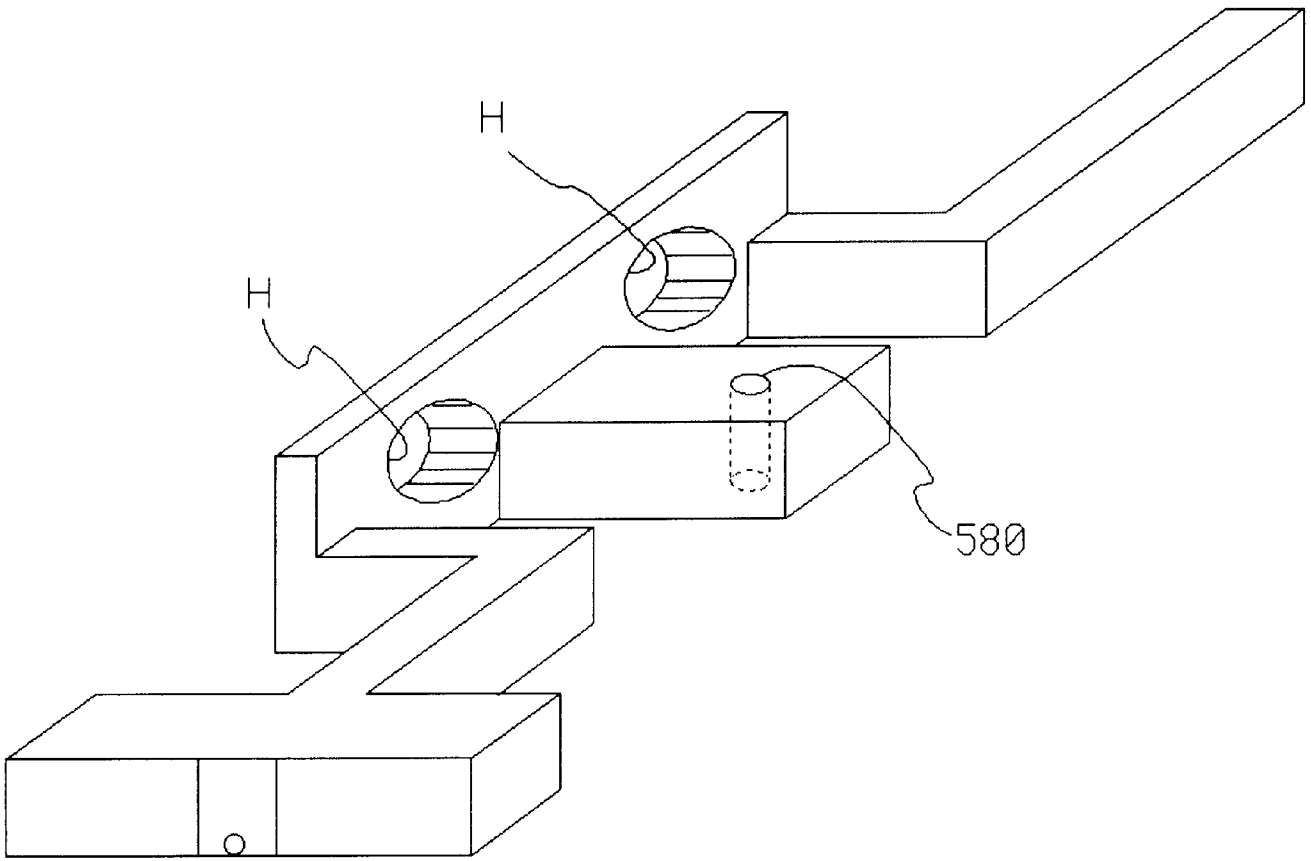

FIG. 14 illustrates another embodiment. Holes H accept a user's fingers, and allow the user to hold the device. For example, the user may place the little finger and the ring finger through the holes. Then, with the thumb and index finger, the user manipulates the screw (not shown) into the tube 580.

Figure 16:
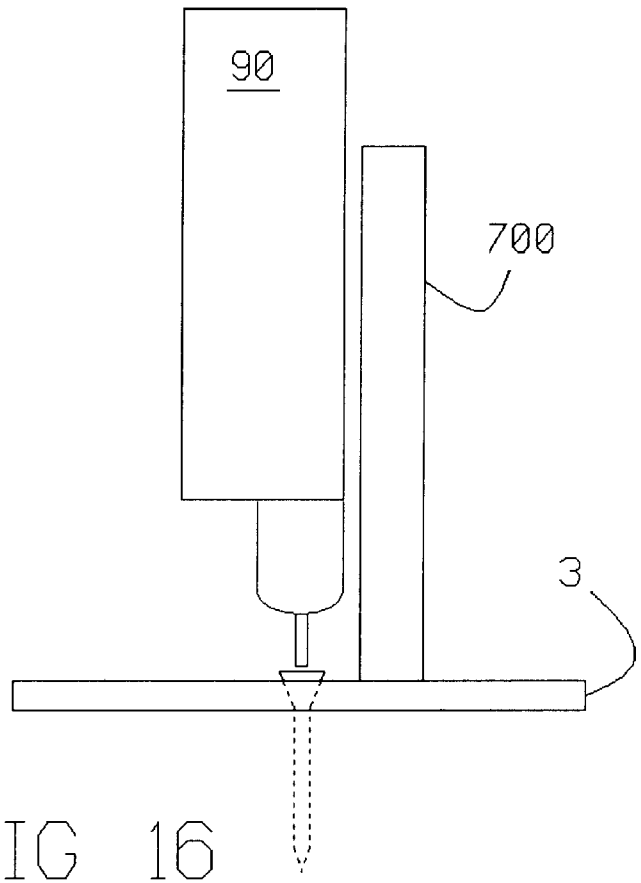
Figure 15:
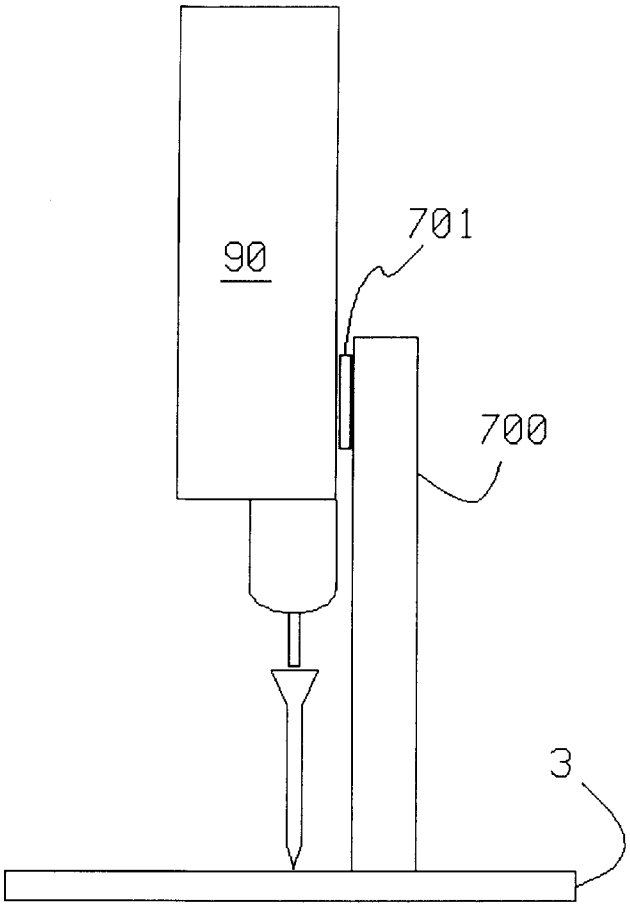

In FIGS. 15 and 16, a component 700 is slide-mounted to drill 90, by a spring-loaded slide 701, thereby allowing it to remain in contact with sheet 3 as the drill travels toward the sheet. That component 700 can take the form of an ultrasonic stud sensor, many types of which are commercially available. The spring-loading of the component 700 maintains it in contact with the sheet 3, as the drill 90 withdraws.

Figure 18:
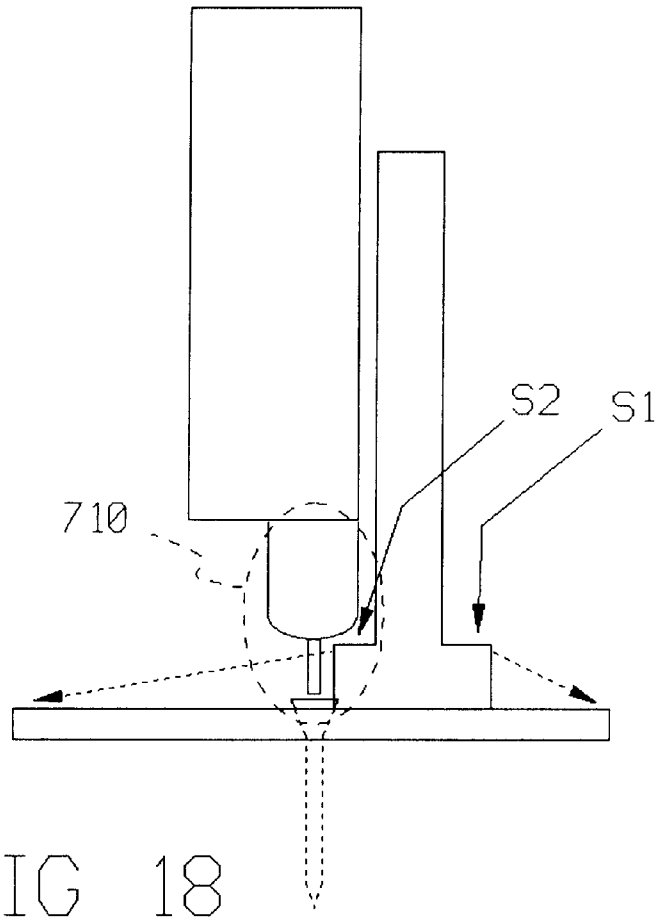
Figure 17:
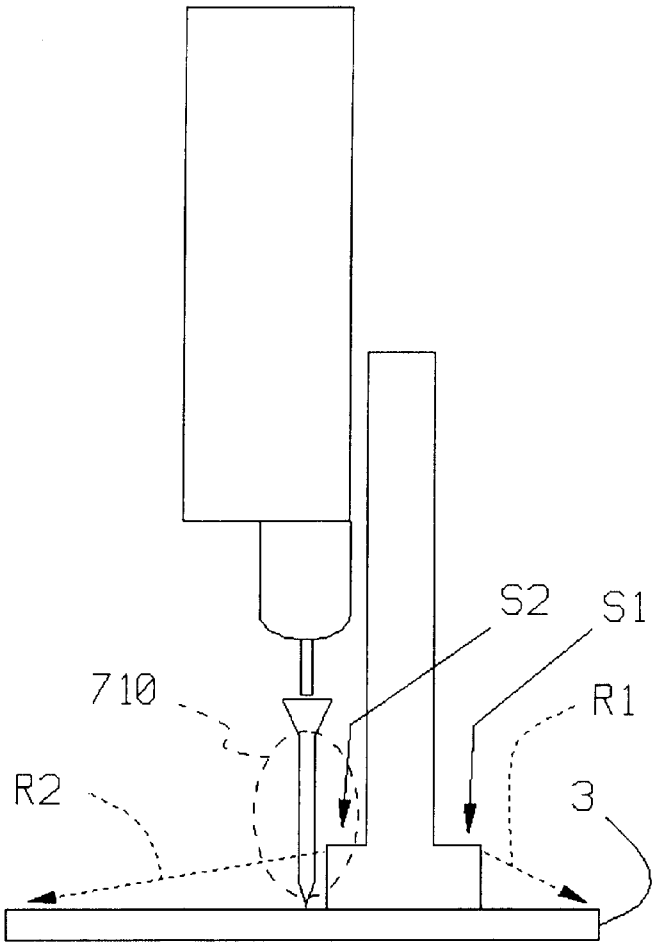

Alternately, that component 700, shown in FIGS. 17 and 18, can carry two optical projectors S1 and S2, which project light rays R1 and R2 which are used as described above. The advantage of the apparatus of FIG. 17 is that, initially, the drill does not obstruct the light beams in region 710. When the drill does obstruct that region 710, as in FIG. 18, the light rays are not needed, because the screw has been positioned already.

Figure 45:
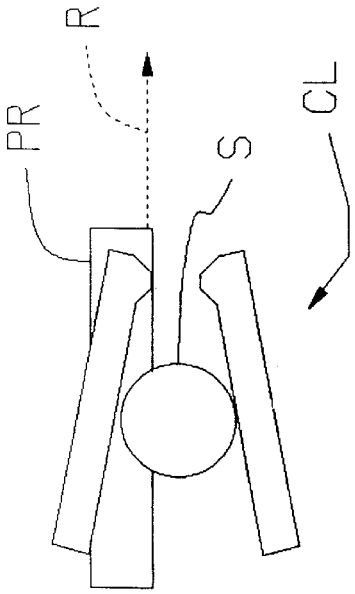
Figure 46:
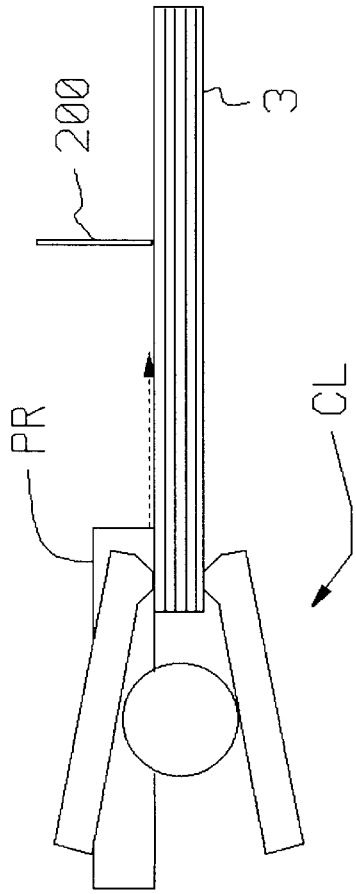

In FIG. 45, a projector PR, which projects light ray R, is fastened to a clothespin-like clamp CL, containing a spring S. FIG. 46 shows the clamp CL clamped to a sheet 3 of plywood. The ray R grazes the surface of the sheet 3, forming a visible line. The projector is adjustable, to allow ray R to be positioned to assume the grazing position, by the apparatus shown in FIG. 47.

A bracket BR is fastened to the clamp CL. Two threaded PINs, attached to the projector PR, mate with slots SL in the bracket BR, allowing the projector PR to slide upward and downward. Threaded nuts (not shown) lock the projector in position.

Figure 47:
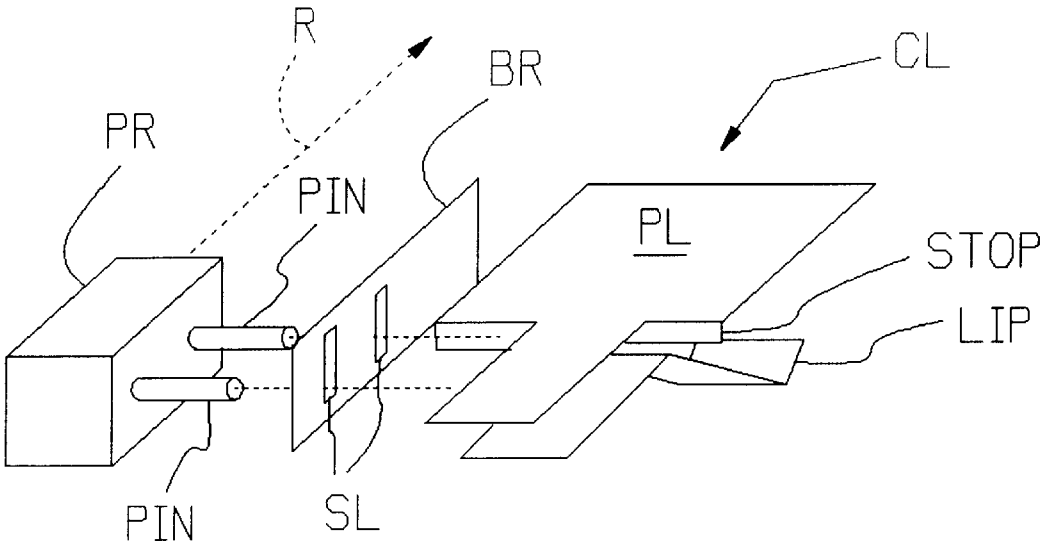
Figure 48:
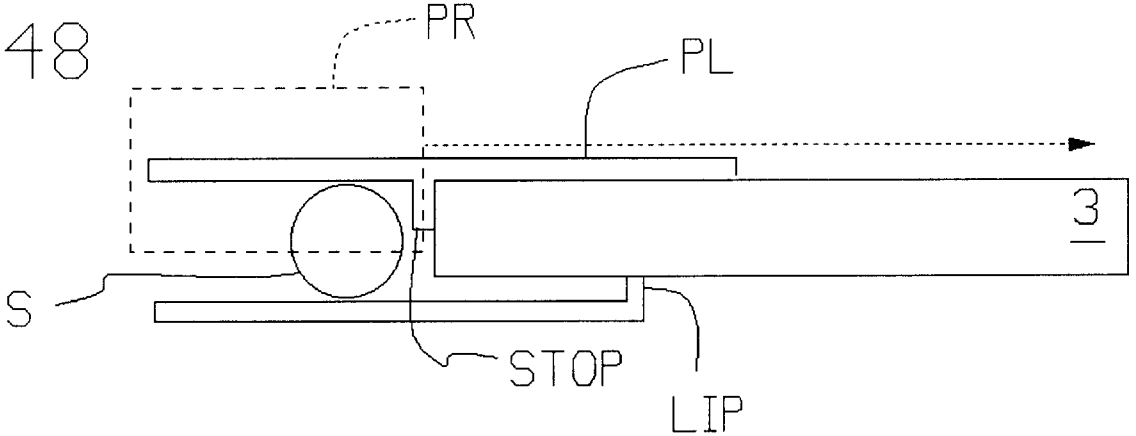

The clamp CL of FIG. 47 contains a STOP and a LIP. These function as in FIG. 48. The LIP assures that plate PL lies flat on the sheet 3, by applying a clamping force along a line about which the entire assembly can pivot, thereby allowing plate PL to pivot into flatness. The STOP acts as a positioning surface, to align the ray R perpendicular with the edge of the sheet to which the clamp CL is clamped.

It may be desired that ray R in FIG. 46 does not graze the sheet 3. Thus, no line will be formed on the sheet 3, although dust in the air will probably render the ray R visible. But when fastener 200 is moved into intersection with the ray, the ray illuminates it, thereby indicating that the fastener is in-line with the ray R.

Figure 50:
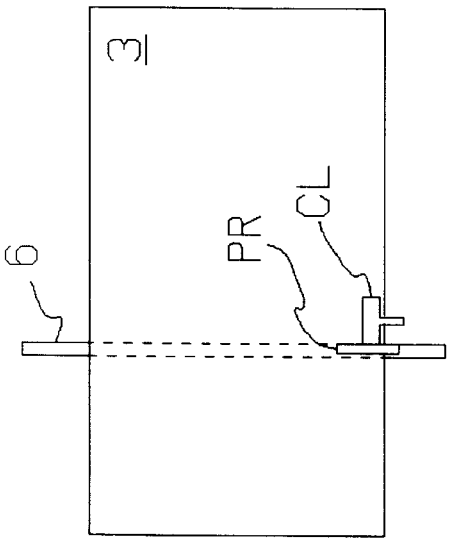
FIGS. 45–50 illustrate another form of the invention.
Figure 49:
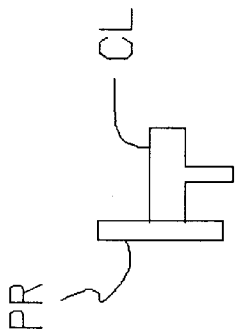

In FIG. 49, the projector PR is offset to the side of clamp CL. The reason is to allow clamp CL in FIG. 50 to clamp the sheet 3, while allowing the projector PR to lie above the framing member 6. There is no space at the interface of framing member 6 and sheet 3 into which the jaws of clamp 3 can fit.

An exception to this statement is possible. The sheet 3, at point P9 in FIG. 50, may not be fastened to the framing member at the location where the clamp CL is installed. The sheet is deflected away from the framing member, and one jaw of the clamp CL is inserted between the sheet 3 and the framing member 6. After an appropriate number of screws have been positioned, the clamp CL is removed, and the sheet 3 is screwed down at that location.

ADDITIONAL CONSIDERATIONS

1. The discussion above was framed in terms of drywall screws. However, other types of fasteners, such as deck screws and power-driven nails, can be used, and other fastener drivers can be used, such as nail guns, gunpowder-charged power hammers, and so on.

2. In one form of the invention, the projectors are made an integral part of a fastener driver, such as a drill or a nail gun, as indicated in FIG. 9A. In another form of the invention, an apparatus is provided for retro-fitting to an existing fastener driver, such as the apparatus in FIG. 12.

3. In one form of the invention, the sheet 3 is four feet wide, by a standardized length, such as 8, 10, 12 feet, and so on. Thus, if the invention is positioned as shown in FIG. 9, each beam B will be about two or three feet in length. The sheet comprises two pairs of opposing edges. For example, in a 4×8 sheet, the two four-foot edges form one pair of opposing edges, and the two eight-foot edges form another pair.

4. The beams B in FIG. 9, if extended, will intersect, forming a V. Each adjustment about the pivot P in FIG. 10 will change that angle. That is, both projectors S1 and S2 need not be adjusted, in order for that angle to change, although they can be.

Figure 51:
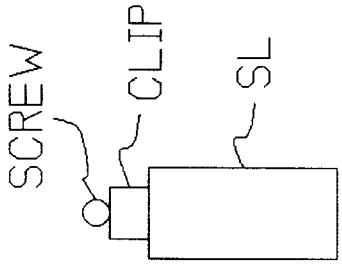
FIG. 51 illustrates another form of the invention.

5. FIG. 51 illustrates another form of the invention. A commercially available ultrasonic stud locator SL, commonly called a "Stud Sensor" or "Stud Finder," is shown. Attached to it, is a clip CLIP for holding a nail or SCREW. The clip is positioned so that, when the stud locator is held in its normal position over a stud, the nail held by the clip will also lie over the stud.

Figure 53:
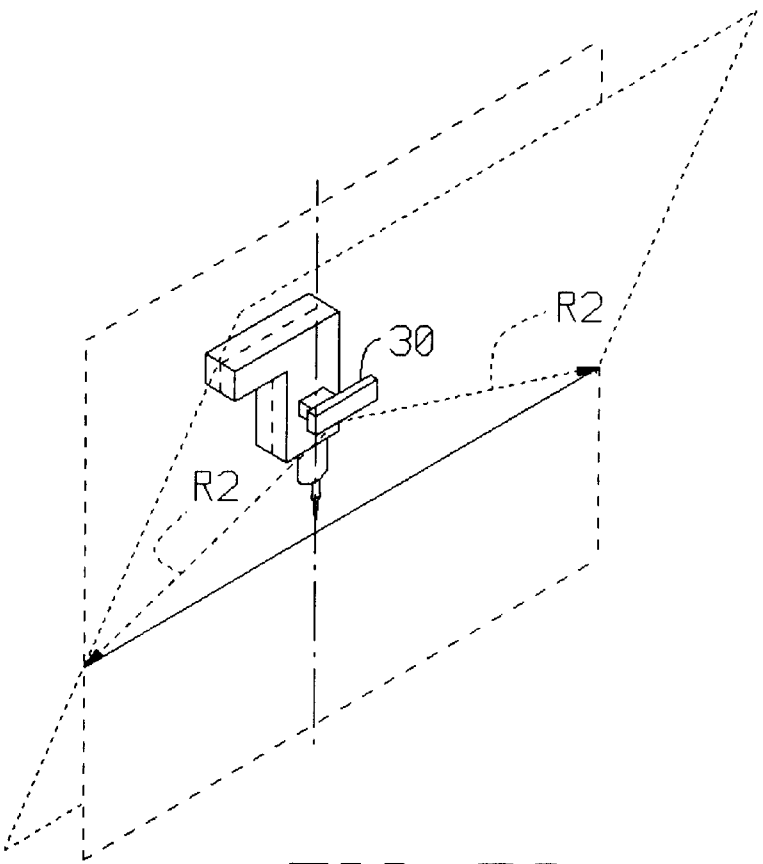
FIG. 53 illustrates rays R2 replacing rays R of FIG. 52.
Figure 52:
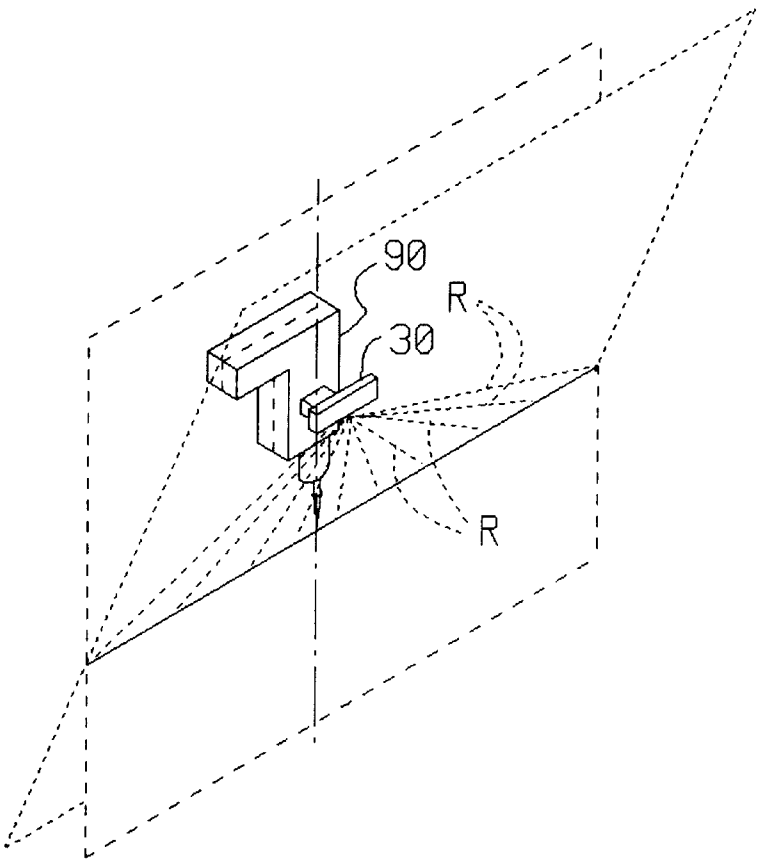
FIG. 52 illustrates rays R forming a sheet of light.

6. FIG. 52 illustrates rays R, projected by projector 30, and which form a fan-shaped sheet of light. If the rays R are fixedly positioned with respect to the drill 90, then they can be replaced by a pair of rays R2, shown in FIG. 53. The invention is used as explained in connection with FIG. 9.

Figure 54:
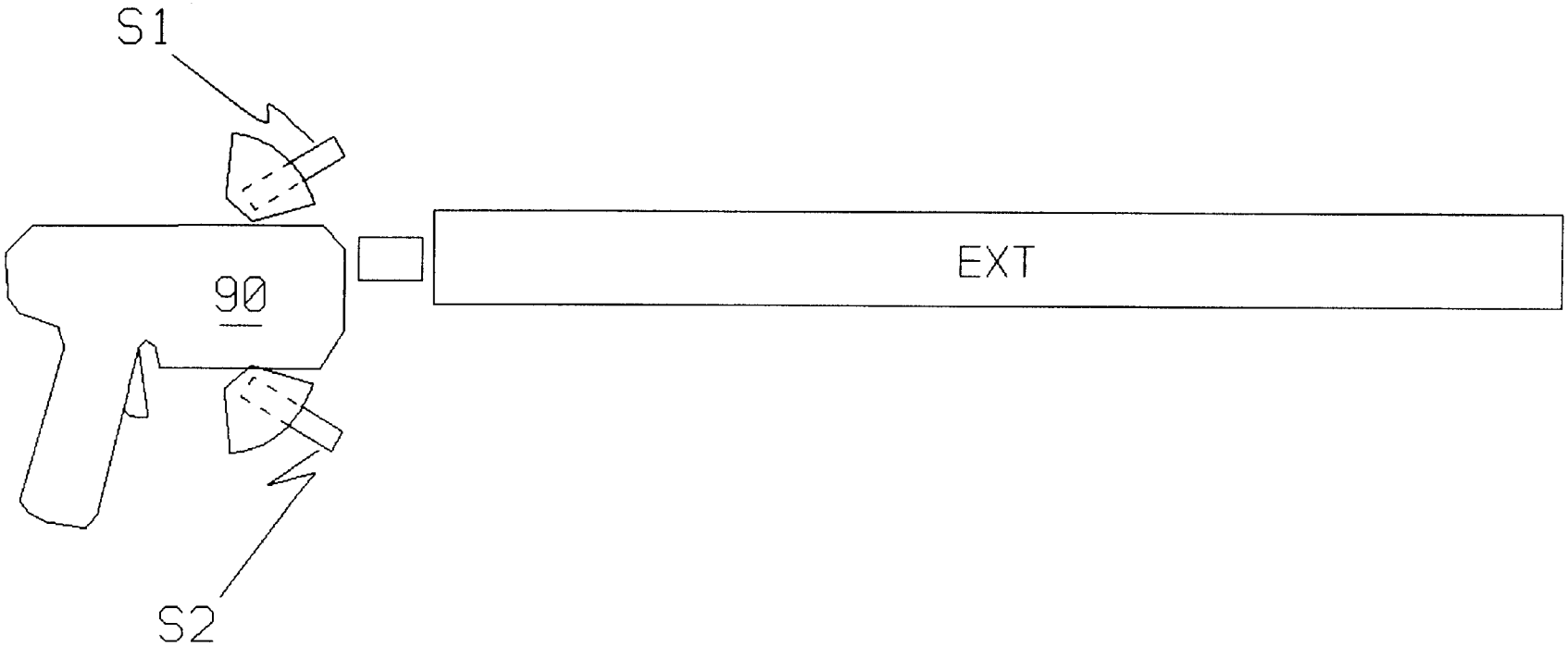
FIG. 54 illustrates one form of the invention.

7. FIG. 54 illustrates an electric drill 90, fitted with an extension EXT, which represents a self-feeding mechanism which feeds screws to the drill, for driving the screws into flooring material, while the human operator (not shown) remains in a standing position. The invention can be used with this apparatus, as indicated by projectors S1 and S2.

ADDITIONAL EMBODIMENT

Figures 55, 58, 59:
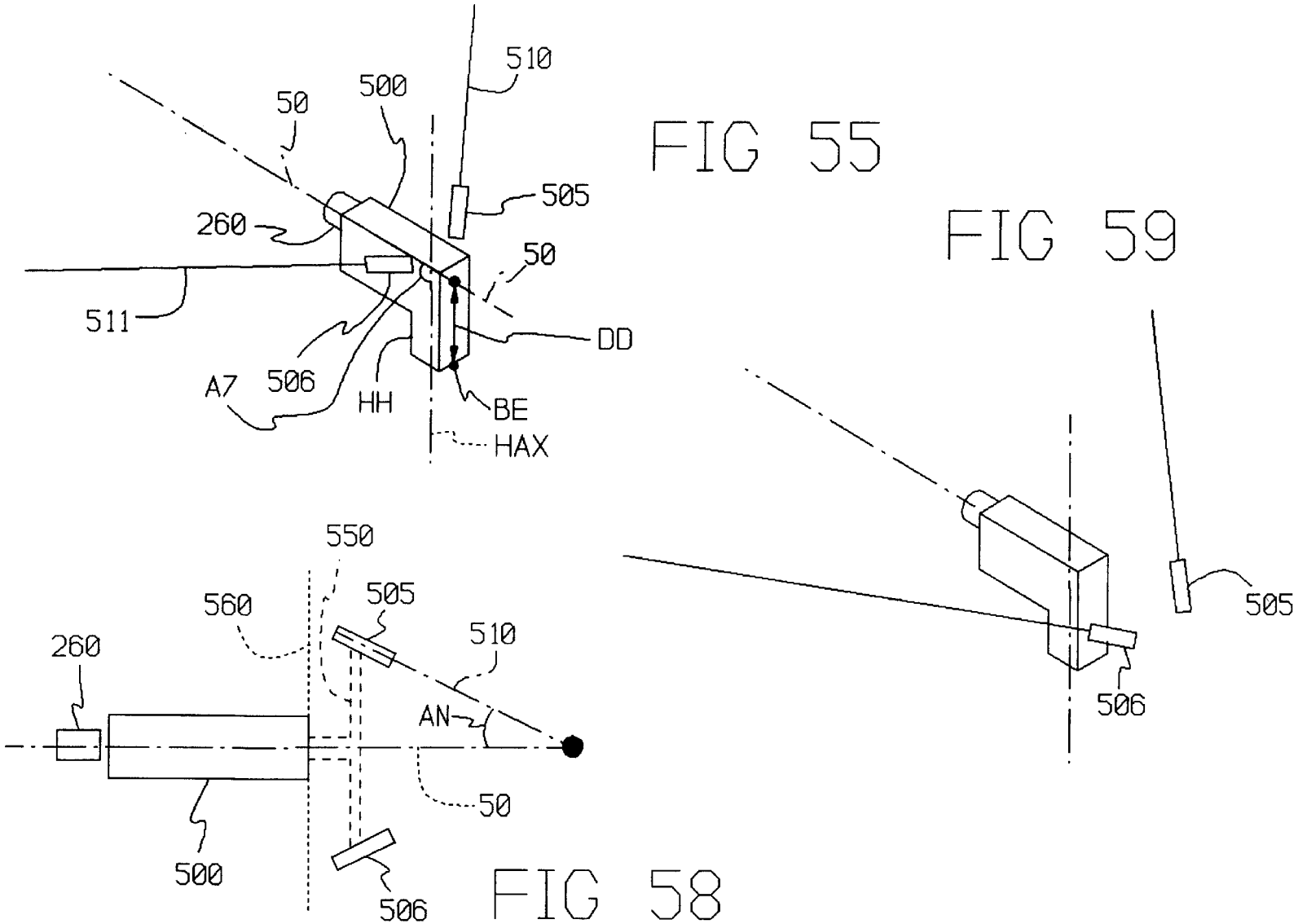
FIG. 55 is a simplified view of another form of the invention.
FIGS. 58 and 59 show another form of the invention, wherein lasers 505 and 506 lie aft of the end 560 in FIG. 58 of the drywall screw gun 500.

FIG. 55 is a simplified perspective view of one form of the invention. A drywall screw gun 500 supports two lasers 505 and 506, which project light beams along optical axes 510 and 511. A support for the lasers is not shown in this Figure.

Figure 56:
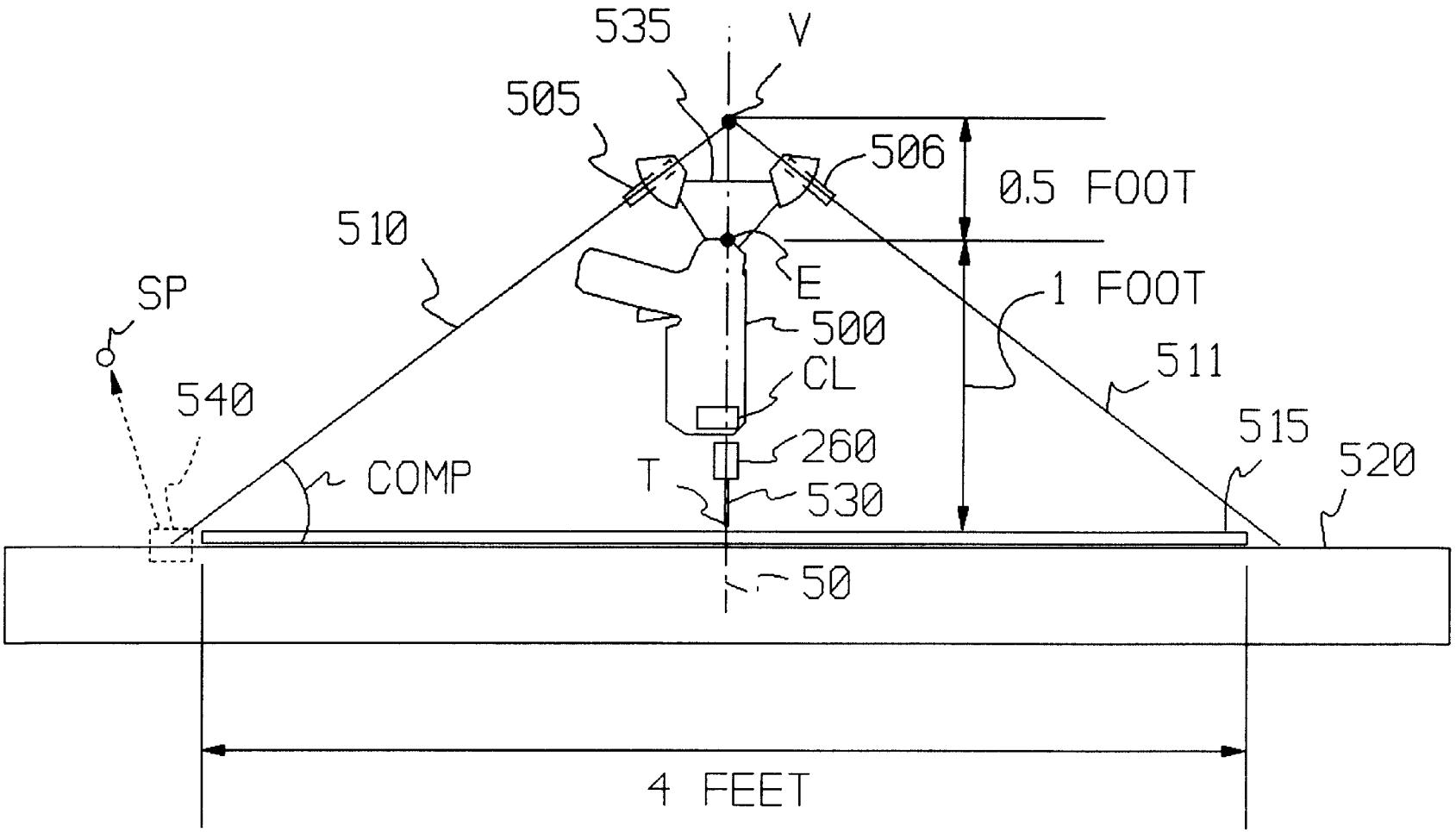
FIG. 56 shows the invention of FIG. 55, positioned perpendicularly to a sheet 515 of sheet rock, ready to drive a drywall screw 530.

FIG. 56 is an elevational view of a similar system, shown adjacent a sheet of drywall 515, which is supported by a framing member 520, such as a 2×4 piece of lumber.

Representative dimensions are shown in FIG. 56. The drywall screw gun 500, plus screw 530, is approximately one foot long, as indicated, measured from the tip T of the 15/8 inch drywall screw 530 to the end E of the gun 500. Axes 510 and 511 intersect at a vertex V, which is about 0.5 foot above the end E, as indicated.

The drywall sheet 515 is four feet wide, as indicated. Axis 510 intersects the framing member 520 within dashed box 540, and generates a spot SP, shown as a top view. Axis 511 generates a similar spot (not shown).

Figure 57:
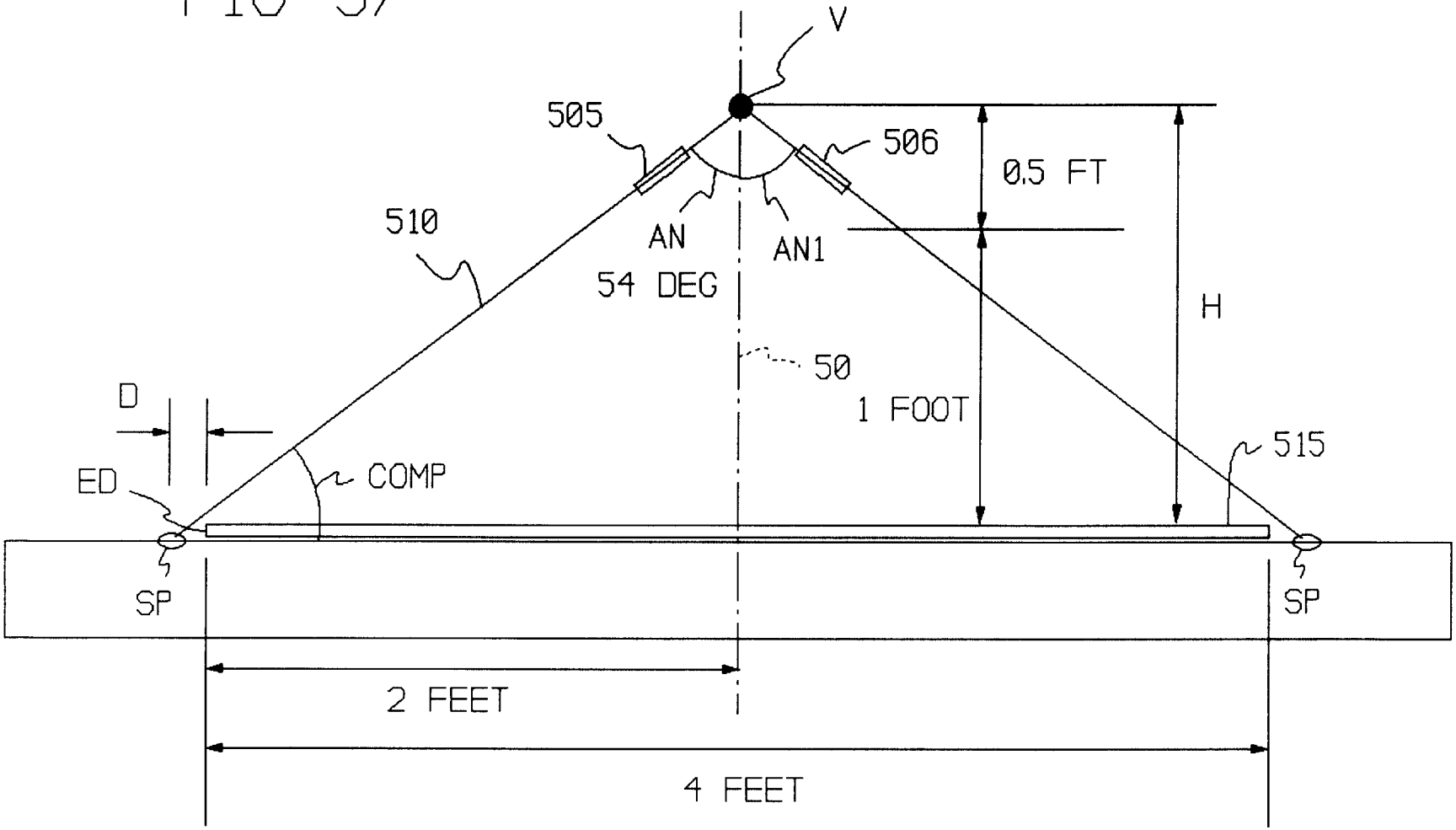
FIG. 57 is a simplified representation of FIG. 56.

FIG. 57 is a simplification of FIG. 56, and will be used to compute numerical values of certain angles. If dimension D, the displacement of the spot SP from the edge ED of the drywall sheet 515, is two inches, then angle AN is about 55 degrees. That is, 55 degrees is the inverse tangent of the quantity (26/18), 26 being the distance in inches between spot SP and axis 50, and 18 being the distance from vertex V to the sheet 515.

Stated in other words, the angle AN between the optical axis 510 and the axis 50 of the drill bit, or drill chuck 260, is about 55 degrees.

of course, the angle AN can be different, if the equipment is designed differently. For example, for a larger screw gun 500, vertex V may be positioned 26 inches above the drywall sheet. In that case, angle AN would be 45 degrees. For a smaller gun 500, vertex V may be located at one foot from the sheet 515. In that case, angle AN would be about 65 degrees. Therefore, it is contemplated that, in several embodiments, angle AN lies between 45 and 65 degrees.

The system is symmetrical, so that a corresponding angle AN1 also exists, preferably having the same value as AN.

FIG. 59 illustrates another embodiment, wherein lasers 505 and 506 are positioned behind gun 500. FIG. 58 is a top view of the system, and shows angle AN, together with laser 505, optical axis 510, and drill axis 50. A bracket 550 is shown. A significant features is that the lasers 505 and 506 are positioned aft of all mechanical components of the gun 500. That is, boundary 560 in FIG. 58 indicates the aft limit of the mechanical components of the gun 500.

Figures 60, 61:
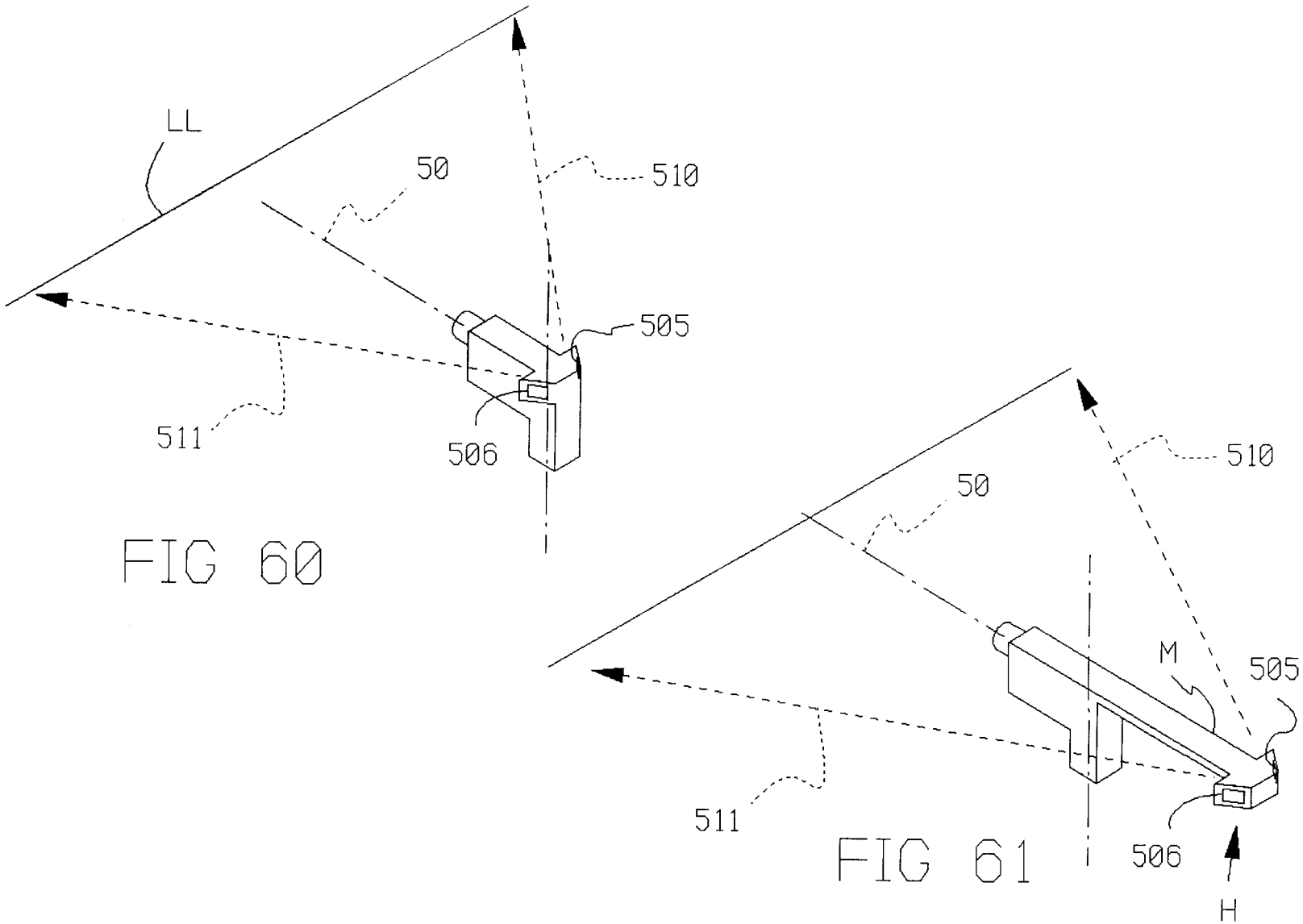
FIGS. 60, 61, 62, and 63 illustrate several approaches to supporting the lasers 505 and 506, by using collapsible, or folding, masts M.

FIG. 60 shows the lasers 505 and 506 supported within a housing H, attached to the gun 500. Housing H may be integral with the housing of the gun 500. In FIG. 61, the housing H is supported by a mast M. This mast M will allow the increased height of the vertex V, discussed in connection with FIG. 57. As stated above, the vertex may lie 26 inches from the sheet 515.

Figure 62:
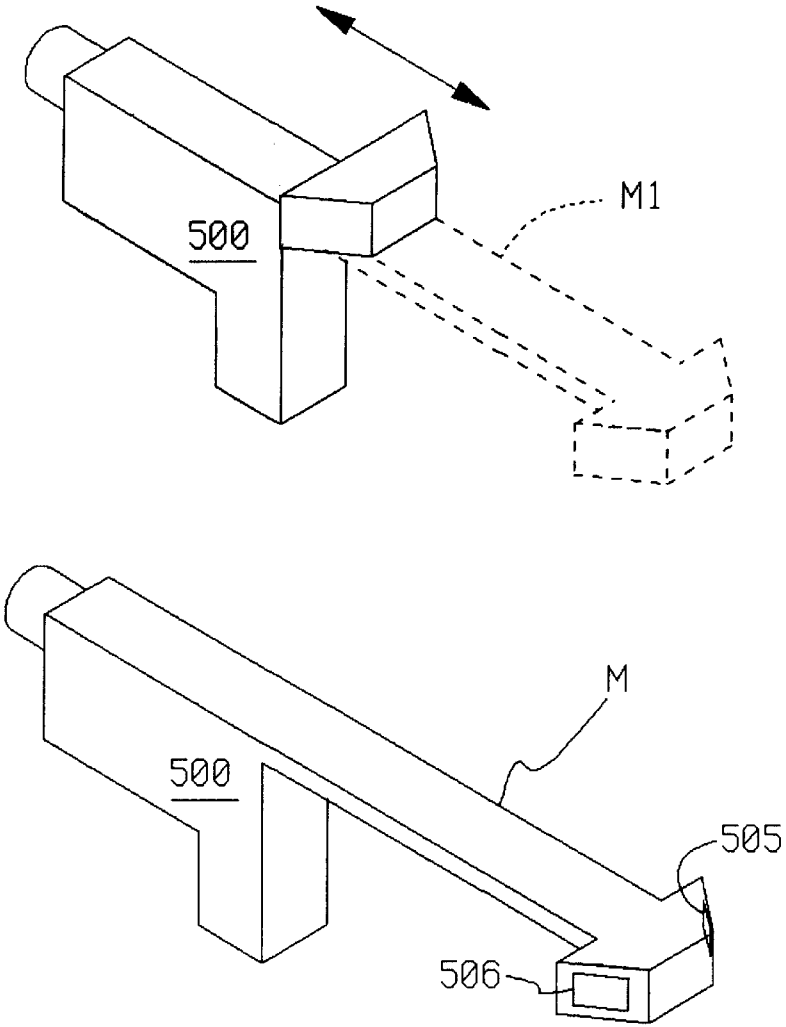

For storage and transport, mast M may be made collapsible. For example, in FIG. 62, mast M can telescope into the gun 500, between the phantom position M1 and solid position M. The telescoping can involve a single-piece mast sliding into a pocket (not shown), or a multiple-piece telescoping mast.

Figure 63:
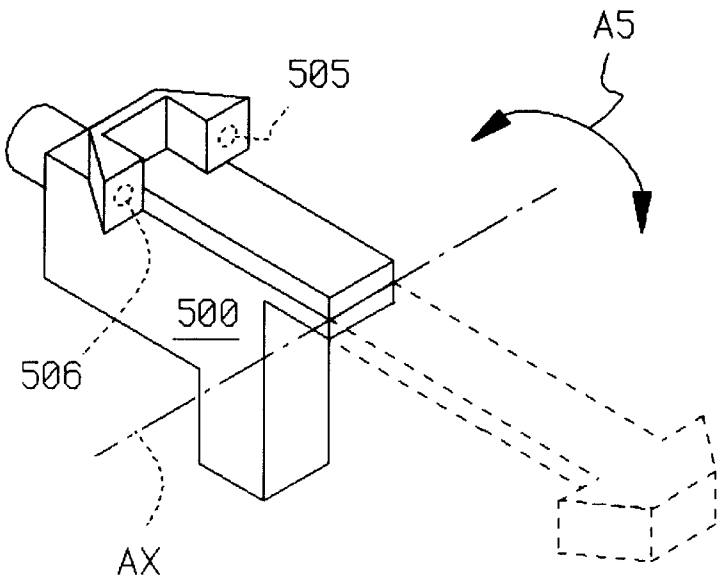

In FIG. 63, the mast M may pivot about axis AX, as indicated by arrow A5. In another embodiment (not shown), the pivot axis may be vertical, so that the mast swings in a plane parallel to axis 50.

Figure 64:
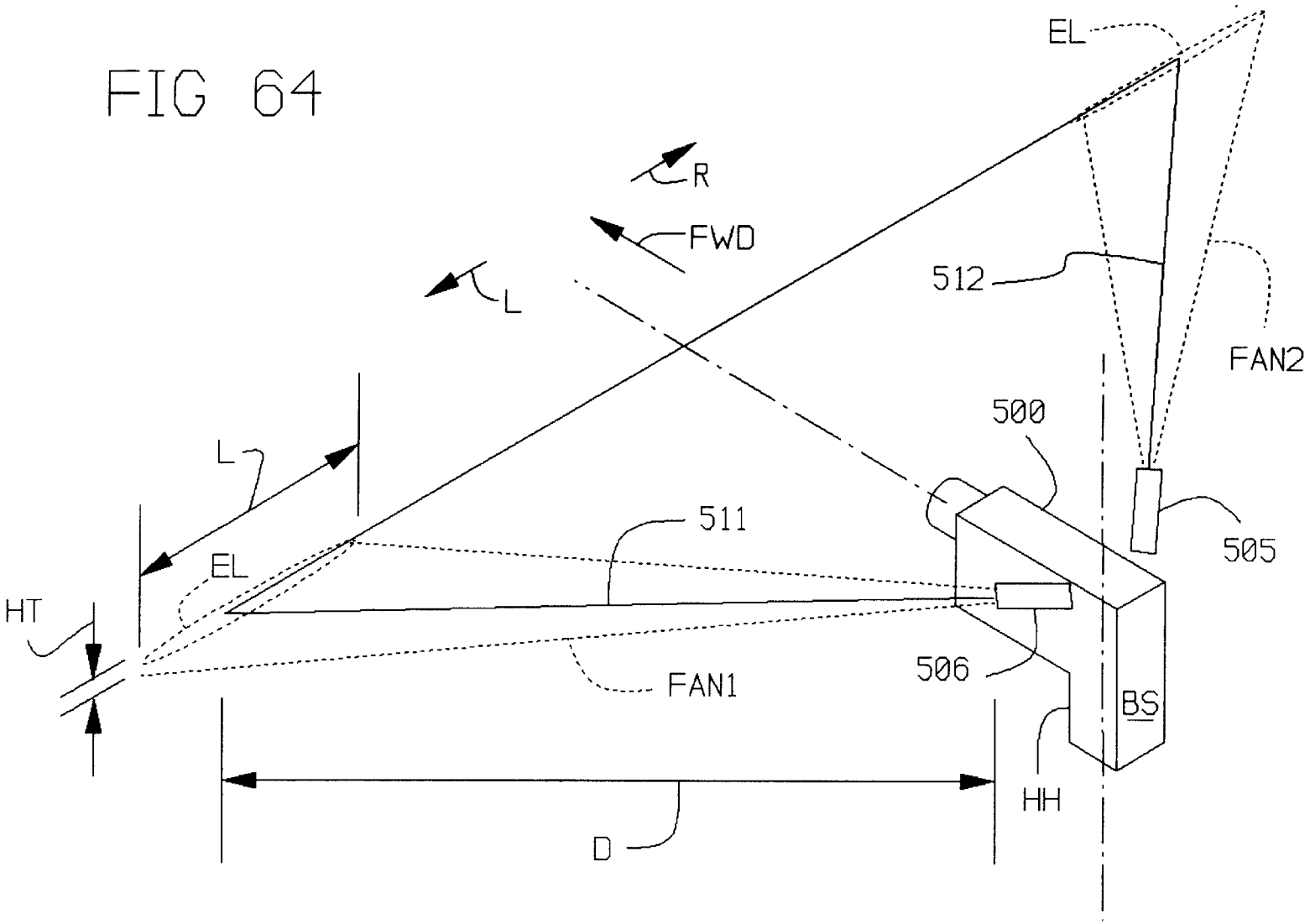
FIG. 64 shows lasers 505 and 506 projecting fan-like beams, which project elliptical spots EL.

FIG. 64 illustrates another embodiment. Drywall screw gun 500 supports lasers 505 and 506. The lasers project fan-shaped laser beams FAN1 and FAN2. Beam FAN1 produces an elliptical spot EL. When the laser 506 is positioned wuch that distance D is about 2.5 feet, corresponding roughly to the positioning shown in FIG. 57, the length L of the elliptical spot EL is preferably in the range from 5 inches to 18 inches. The height HT of the spot EL lies in the range of ⅛ inch to about ½ inch.

Lasers producing fan-shaped spots are commercially available.

Significantly, substantially all optical energy is confined to the elliptical spot EL, and that spot EL can be located completely upon the edge of lumber of nominal 2-inch thickness, namely, lumber which is 1.5 inches thick.

Another significant feature is that the length/height ratio of the spot EL is at least ten. For example, if the height HT is ½ inch, and the length L is 5 inches, the ratio is 10. If the height HT is ¼ inch, and the length L is 12 inches, the ratio is 48. All ratios from 10 to 50 are contemplated, as well as ratios higher than 50.

The fans FAN1 and FAN2 are substantially flat, having the ratios just described.

ADDITIONAL CONSIDERATIONS

If angle AN in FIG. 57 is 55 degrees, then angle COMP is the geometric complement, and will equal 90 minus AN, or 35 degrees. If angle AN equals 45 degrees, then angle COMP will equal 45 degrees. If angle AN equals 65 degrees, then angle COMP will equal 25 degrees.

The invention covers any angle AN in FIG. 57 between 45 and 55 degrees. In one form of the invention, the lasers 505 and 506 are adjustable, and can pivot about vertex V, or other points, to adjust angles AN and AN1.

A significant feature of the conventional drywall screw gun is that it resembles a modified electric drill. In FIG. 56, a clutch CL is provided in the drive train. When the resisting force applied to the chuck 260 becomes sufficiently large, the chuck slips. The chuck is adjustable, so that the amount of resisting force required to induce the slip can be varied.

A significant feature of the lasers 505 and 506 is that they produce a light beam having minimal divergence. That is, the spot size of spot SP in FIG. 56, at the distances shown, is preferably 1/8, 1/4, 3/8, 1/2, 5/8, or 3/4 inch in diameter. In one form of the invention, lasers only are used, and no non-coherent light source is used, such as incandescent light.

A significant feature of the use of lasers is that the size of the spot SP in FIG. 56 is sufficiently small that it can fit completely on the edge of the framing member 520. The edge of "two-by" framing members is 1.5 inches in thickness. In contrast, if an ordinary flashlight were to replace laser 505, the spot of light projected by the flashlight onto the framing member 520 would not fully be contained within the 1.5 inch wide edge.

As a result, using ordinary flashlights instead of the lasers 505 and 506 would cause great difficulty in centering the drill chuck 260 over the framing member 520, unless special care were taken to provide a particular focusing arrangement.

Figure 61A:
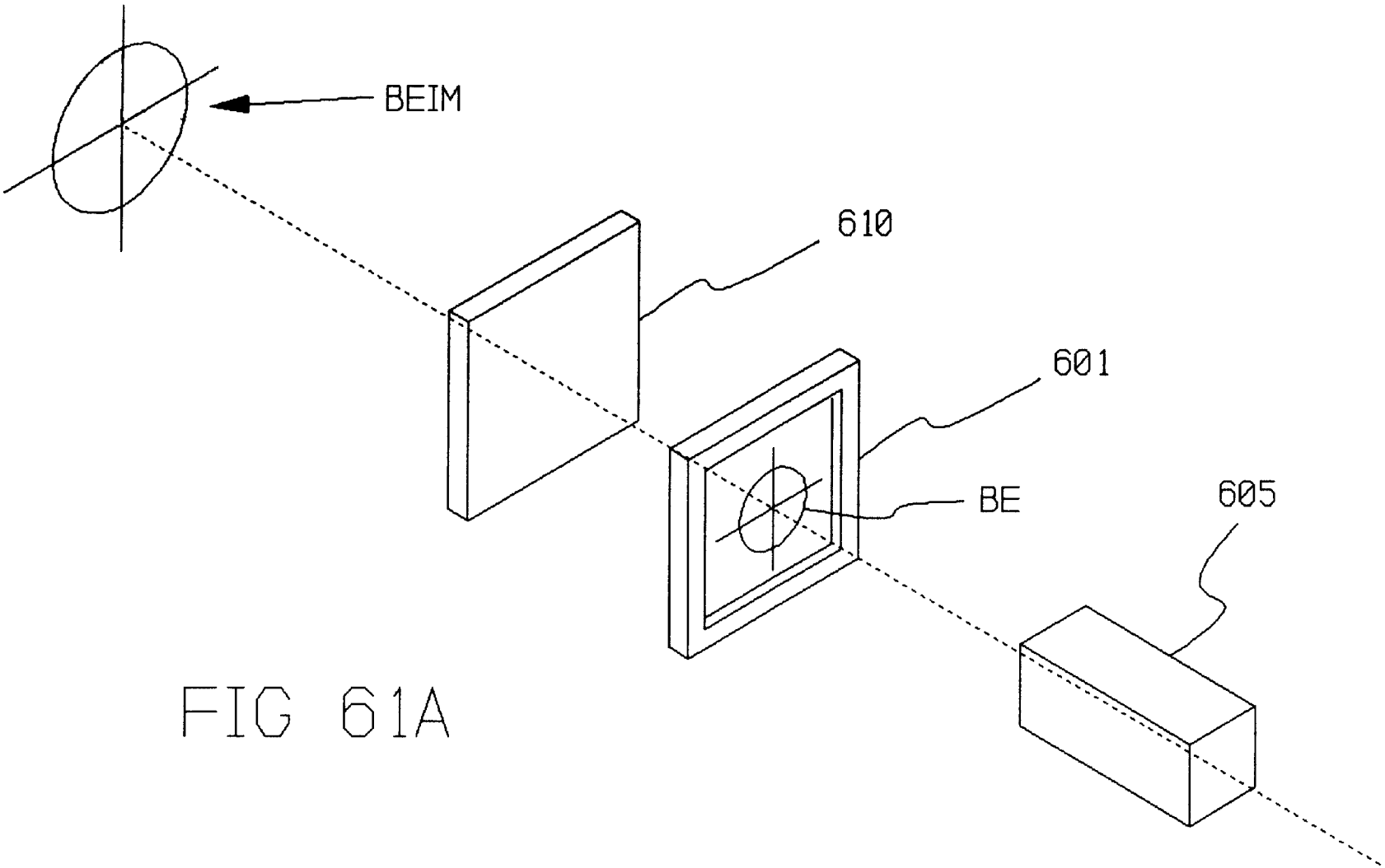
FIG. 61A illustrates a light source 605, a transparent slide 601 containing an image of a bull's eye BE, a focusing system 610, and a projected image BEIM of the bull's eye.

An exemplary focusing arrangement is shown in FIG. 61A. A slide 601, similar to a 35 mm slide, contains an image of a bull's eye BE. A light source 605 and a focusing system 610 generate a projected image BEIM of the bull's eye BE. The projected image BEIM is used in place of spot EL in FIG. 60, and a system of FIG. 61A replaces each of the laser 505 and 506 in FIG. 56.

It is not necessary that the image BEIM be enlarged to the extent that a 35 mm projector enlarges a 35 mm slide. In one embodiment, no significant enlargement occurs at all.

The slide 601 may not be necessary. The imaging system 610 may, for example, use a tungsten filament (not shown) within the light source 605 as a point source, or line source, of light, and project that point, or line, as the image which replaces the bull's eye image BEIM.

In FIG. 56, the optical axes 510, 511, and the drill axis 50 lie in the same plane.

In FIG. 57, the angle between the two optical axes 510 and 511 is the sum of angles AN and AN1. Thus, if angle AN equals 45 degrees, and angle AN1 equals 45 degrees, the sum is ninety degrees. Axes 510 and 511 would then intersect at 90 degrees.

A significant feature is that a handle HH in FIG. 55 of the gun 500 has an axis generally indicated as HAX. Rays 510 and 511 define a plane, which includes axis 50. Axis HAX is approximately perpendicular to that plane. In one embodiment, handle axis HAX makes an angle A7 of greater than 90 degrees, and less than 120 degrees, with respect to the plane. Angle A7 runs between axis HAX and axis 50.

Another way to describe the handle is based on the distance DD in FIG. 55 between its bottom edge BE and axis 50. That distance DD can be any of 2.5, 3.0, 3.5, 4.0, 4.5, 5.0, 5.5, or any distance from 2 to 7 inches, or longer.

A forward direction FWD is defined in FIG. 64 as the direction in which the chuck 260 points, that is, the direction to which the gun 500 will be moved, in order to drive a screw. The forward direction FWD is also defined by the direction in which an ordinary screw advances when driven by the gun 500. Directions left L and right R are also defined.

A significant feature of the conventional drywall screw gun is that, in operation, the user presses against the back side BS of the handle HH in FIG. 64, in order to maintain the drill bit (not shown) in engagement with the drywall screw (not shown). The user applies the pressure with the palm, or heel, of the user's hand. Thus, the user applies pressure in the forward direction, but to a surface BS which is transverse, or perpendicular, to that direction.

In contrast, many so-called "electric screwdrivers" comprise cylindrical housings containing a motor, and a rotating screwdriver which is coaxial, and concentric with the cylindrical housing. The user applies forward pressure through friction: the user grasps the housing, and friction allows the user to push the housing forward.

ALIGNMENT

Figure 65:
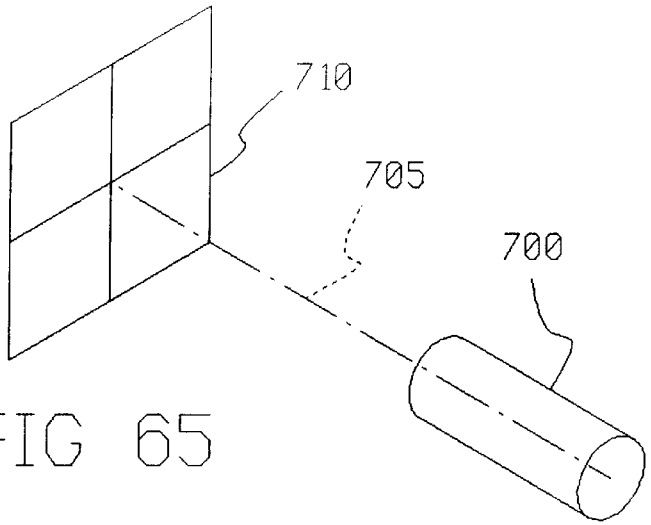
FIG. 65 shows a laser 700 having an ideal, concentric axis 705 defined therein.

It is possible that the light source used, be it laser or focused incandescent, will not be aligned properly. That is, as shown in FIG. 65, an ideal laser 700 is shown, with its idealized optical axis 705 shown. The ideal axis 705 is concentric with cylinder 700. A reference target 710 is shown.

Figure 66:
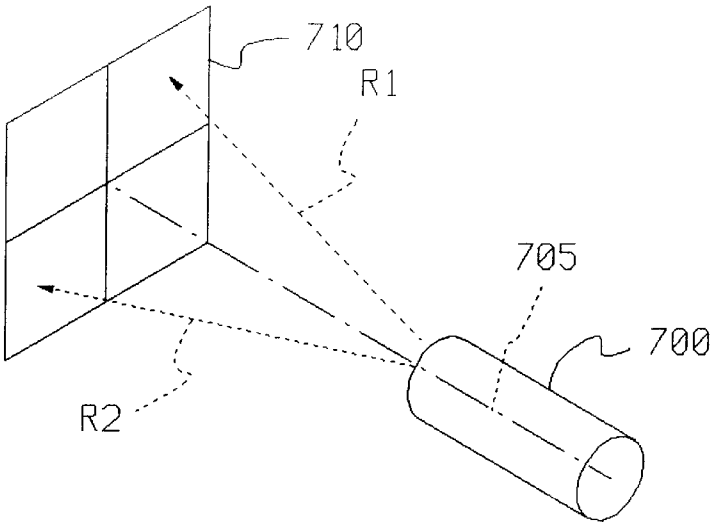
FIG. 66 illustrates two rays R1 and R2 deviating from the ideal axis 705.
Figure 67:
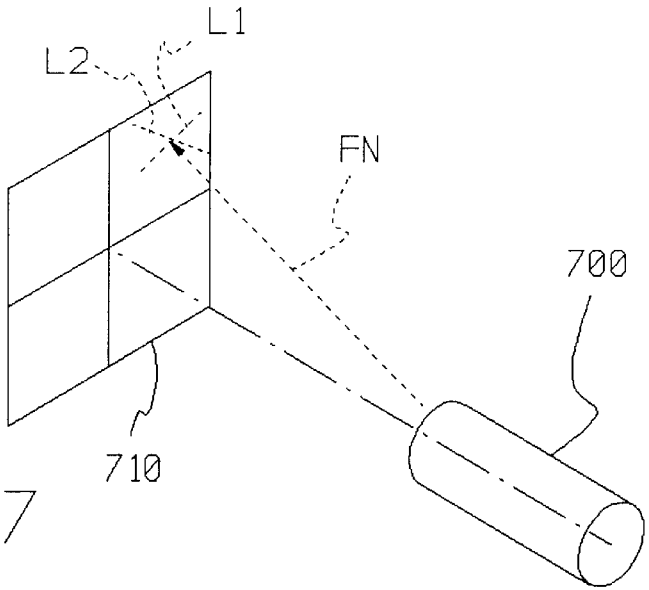
FIG. 67 illustrates a laser 700 projecting a fan FN, and how the line created by the fan FN on target 710 can deviate in at least two ways, as lines L1 and L2.

In the general case, the laser beam will not necessarily coincide with the ideal axis 705, but may deviate, as indicated by rays R1 and R2 in FIG. 66. Also, if a fan-style beam is used, the plane of the fan may further deviate, as shown in FIG. 67. The plane of the fan may strike the target 710 and generate line L1, or line L2, or lines at other angles.

Figure 68:
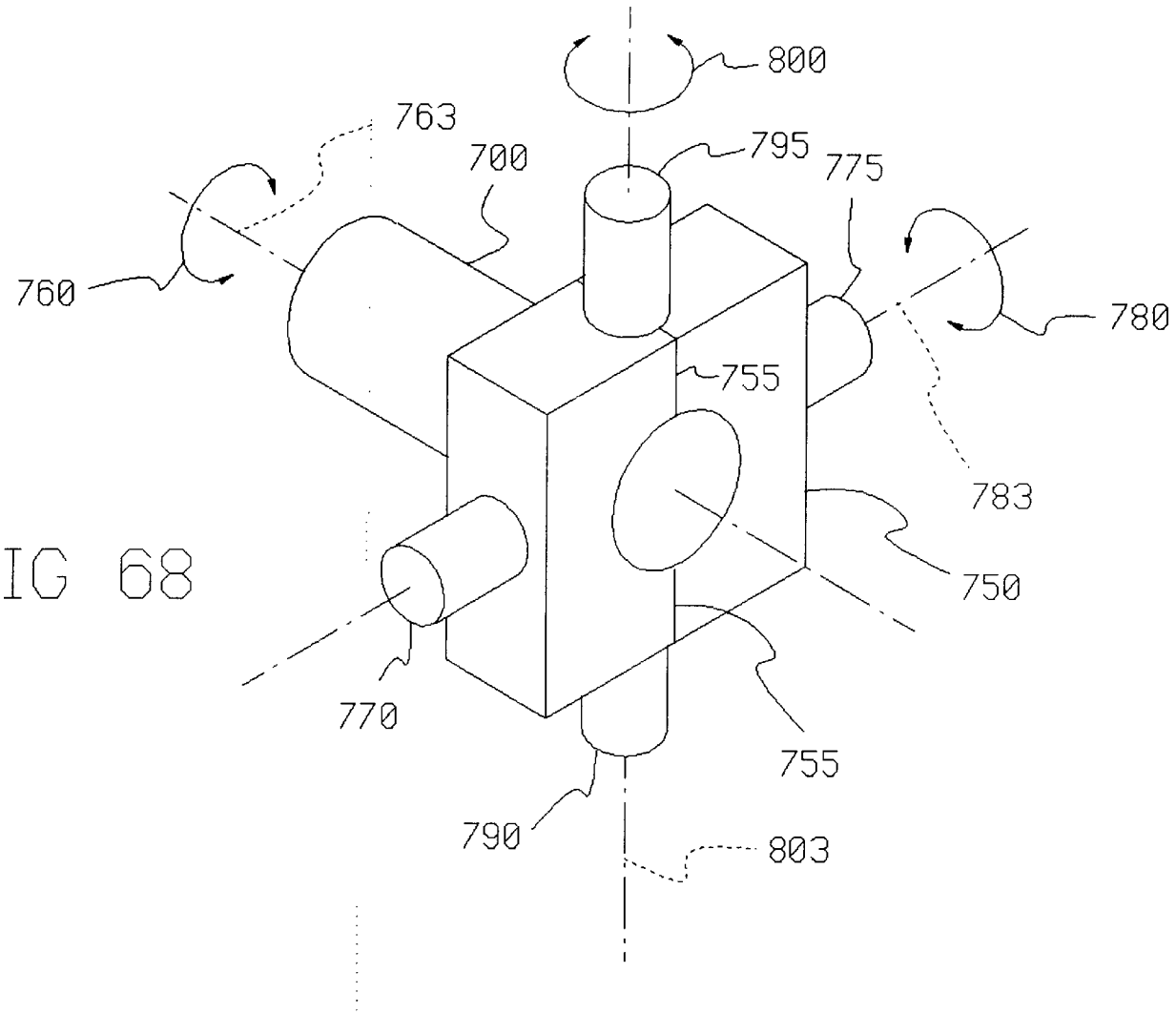
FIG. 68 is a schematic view of a mounting device for laser 700.

FIG. 68 illustrates one type of mounting apparatus which can eliminate, or reduce, the deviations from ideality just described. The laser 700 is clamped into a housing 750, which can be split at seam 755, to allow the clamping function. The laser 700 can rotate as indicated by arrows 760, that is, the laser 700 can "roll," as that term is used in aeronautics, about a roll-axis 763. When the laser 700 is rolled into the proper position, bolts (not shown) clamp the housing 750 tight onto the laser, preventing further roll.

The housing 750 bears a first pair of pins 770 and 775. These mate with appropriate yokes (now shown), and allow rotation as indicated by arrows 780, in the "pitch" direction, or attitude, about a pitch axis 783. A second pair of pins 790 and 795 mate with appropriate yokes (not shown), and allow rotation as indicated by arrows 800, in the "yaw" direction, about yaw axis 803. Both yokes are capable of clamping the housing 750, once adjusted, to prevent further pitch or yaw.

Figure 69:
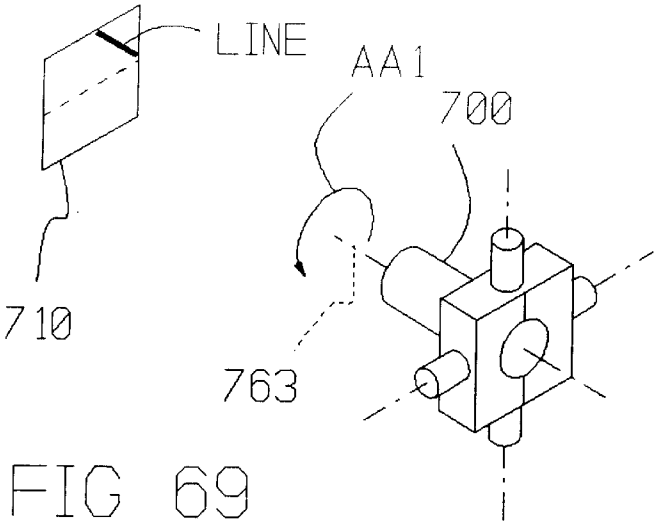
FIGS. 69, 70, 71, and 72 illustrate a sequence of steps utilized in aligning the laser 700, using the apparatus of FIG. 68.

An exemplary adjustment procedure will be described. A fan-style laser beam will be assumed. FIG. 69 illustrates the line LINE which the beam produces on the target 710. The laser is rotated in the direction of arrow AAI, about the roll axis 763 in FIG. 69, to align the laser LINE parallel with reference line 730, as indicated in FIG. 70.

Figure 70:
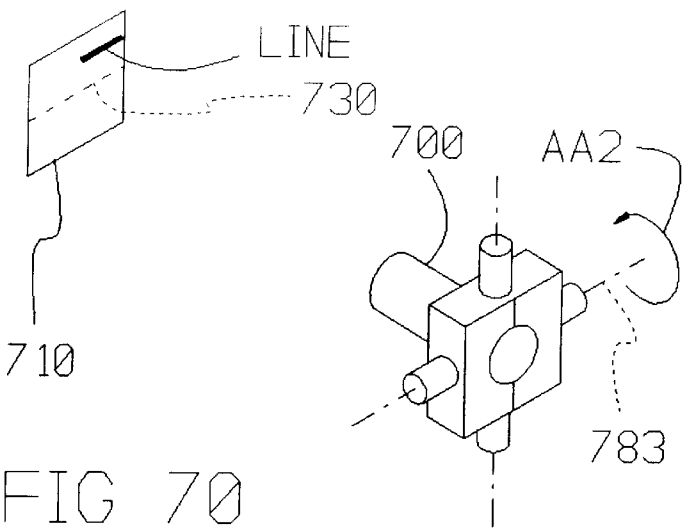
Figure 71:
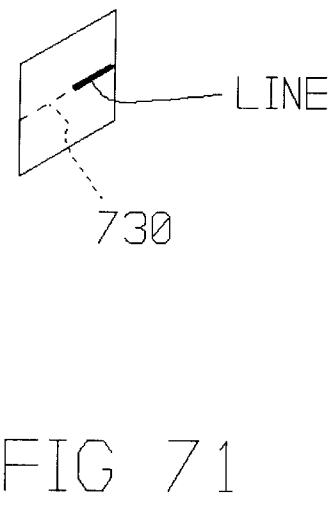
Figure 72:
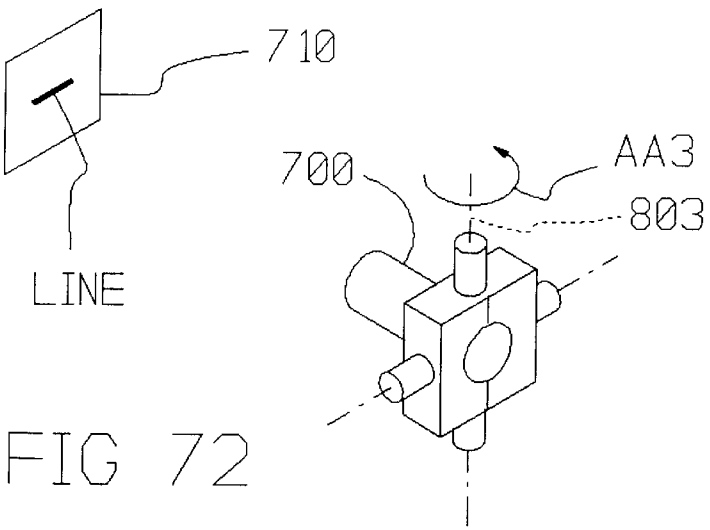

Next, the laser 700 is rotated in the direction of arrow AA2, about the pitch axis 783 in FIG. 70, to move the LINE to coincide with the reference line 730, as indicated in FIG. 71. Finally, in FIG. 72, the laser 700 is rotated in the direction of arrow AA3 in FIG. 72, about the yaw axis 803, to center the LINE on the target 710.

Figure 73:
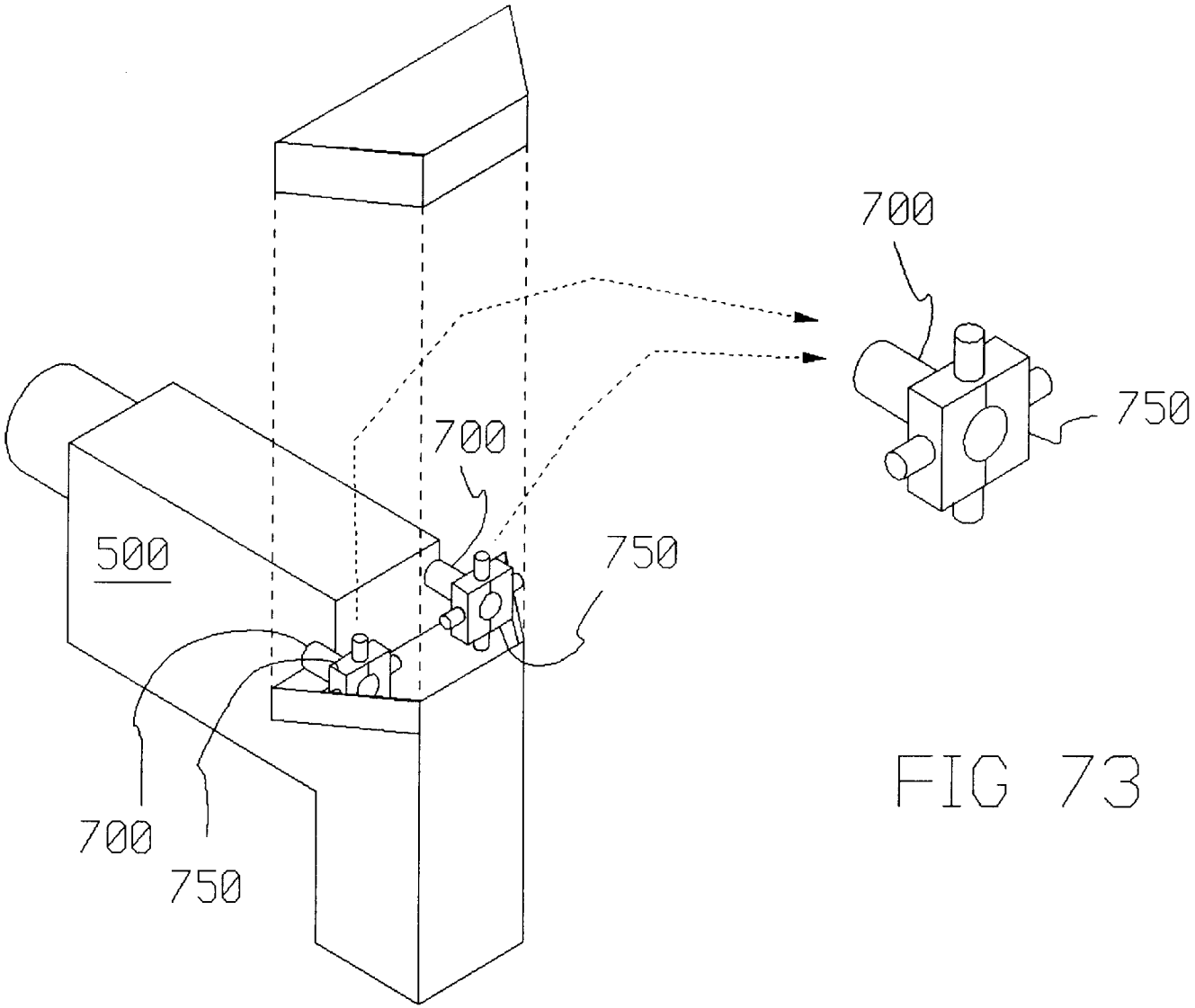
FIG. 73 illustrates two aligning devices 750 mounted in a drywall screw gun 500.

FIG. 73 is a partially exploded view of the shell of a drywall screw gun 500, showing two housings 750 of the type shown in FIG. 68 positioned therein. The lasers 700 are adjusted about the axes just described so that they project their beams as shown in FIGS. 57 or 64, as appropriate. If incandescent sources are used, they may require adjustment also.

One reason why the adjustment may be significant is explained with reference to FIG. 74. The narrow edge EDG of a 2×4 piece of lumber is shown. The narrow edge is 1.5 inches in height, as indicated. If the spot SP projected by the laser 700 is to remain within the ½ inch tall boundary 900, and if the laser is positioned 18 inches away, as indicated, then angle A cannot exceed 0.8 degrees. Angle A is defined as the angle between the ideal optical axis of the laser 700 and the actual ray produced by the paser. The idealized optical axis intersects the centerline CL of the 2×4.

The limit on angle A is computed by realizing that the center of the spot SP cannot rise above, nor fall below the centerline CL by more than ¼ inch, if the spot SP itself is to stay within boundary 900. The inverse tangent of (¼)/18 is 0.8 degrees.)

Figure 76:
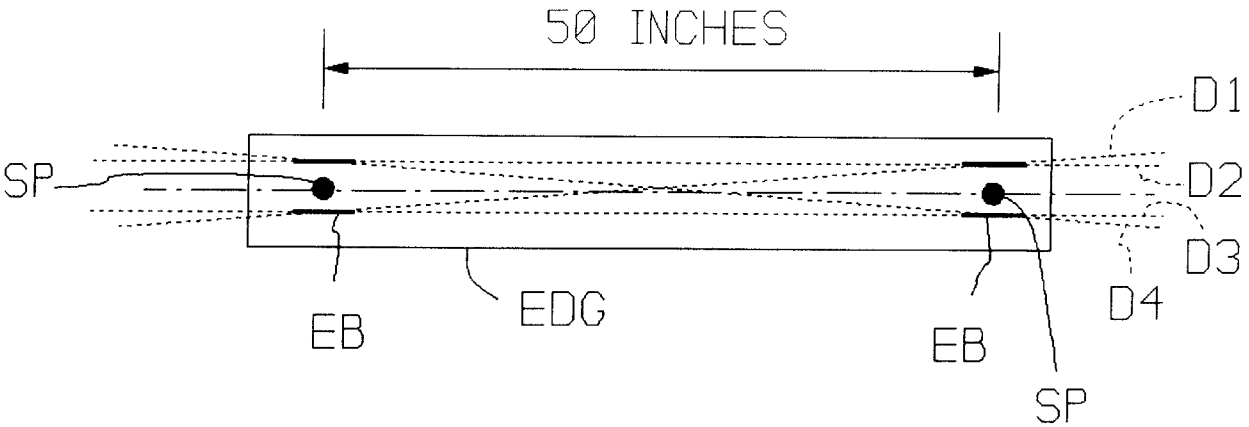
FIG. 76 illustrates four lines D1, D2, D3, and D4, which represent line LL in FIG. 60. Lines D1, D2, D3, and D4 are co-planar with ideal axes 510 and 511 in FIG. 60, and with the drill axis 50.
Figure 77:
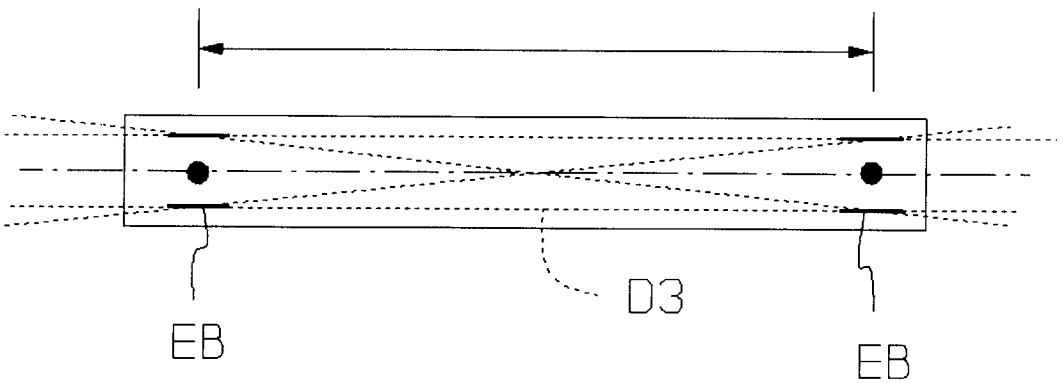
FIG. 77 is similar to FIG. 76, but showing larger error bars EB, and larger deviation.
Figure 75:
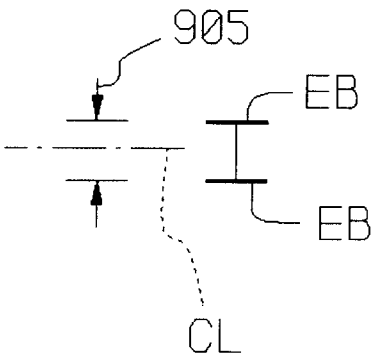
FIG. 75 illustrates a range 905, centerline CL of FIG. 74, and an error bar EB.

Another way to view the limits on the deviation of the laser beam from its ideal axis is shown in FIGS. 75–77. FIG. 75 illustrates a range 905, and the centerline CL of the 2×4. If the ideal axis of the laser intersects the centerline CL, then the spot produced must lie within the boundary 905. Conversely, if the spot is placed on the centerline CL, then the ideal axis of the laser must lie within the range 905. If the range 905 os too large, then placing the spot on the centerline will not cause the screw to enter the 2×4, as will now be explained.

FIG. 76 illustrates two error bars EB, located on the edge EDG of a 2×4. The error bars EB are 50 inches apart, as indicated. If the spots SP produced by the lasers are positioned as shown, the actual axes of the lasers can lie anywhere within the error bars EB, as just explained. Consequently, the line defined by the two spots and the centerline of the chuch (not shown) can assume any of dotted lines D1, D2, D3, or D4, ot any therebetween.

Clearly, if the error bars EB, that is the height of the range 905 in FIG. 75, become sufficiently tall, then the drywall screw may miss the 2×4. FIG. 77 illustrates this possibility.

As the error bars EB increase in height, line D3 approaches the boundary of the 2×4. As a specific example, if the error bars EB were 1.5 inches in height, then, as a matter of probability, line D3 may coincide with the bottom edge of the 2×4. Thus, any screw driven will meet that edge, and will not be properly driven into the 2×4.

Figure 74:
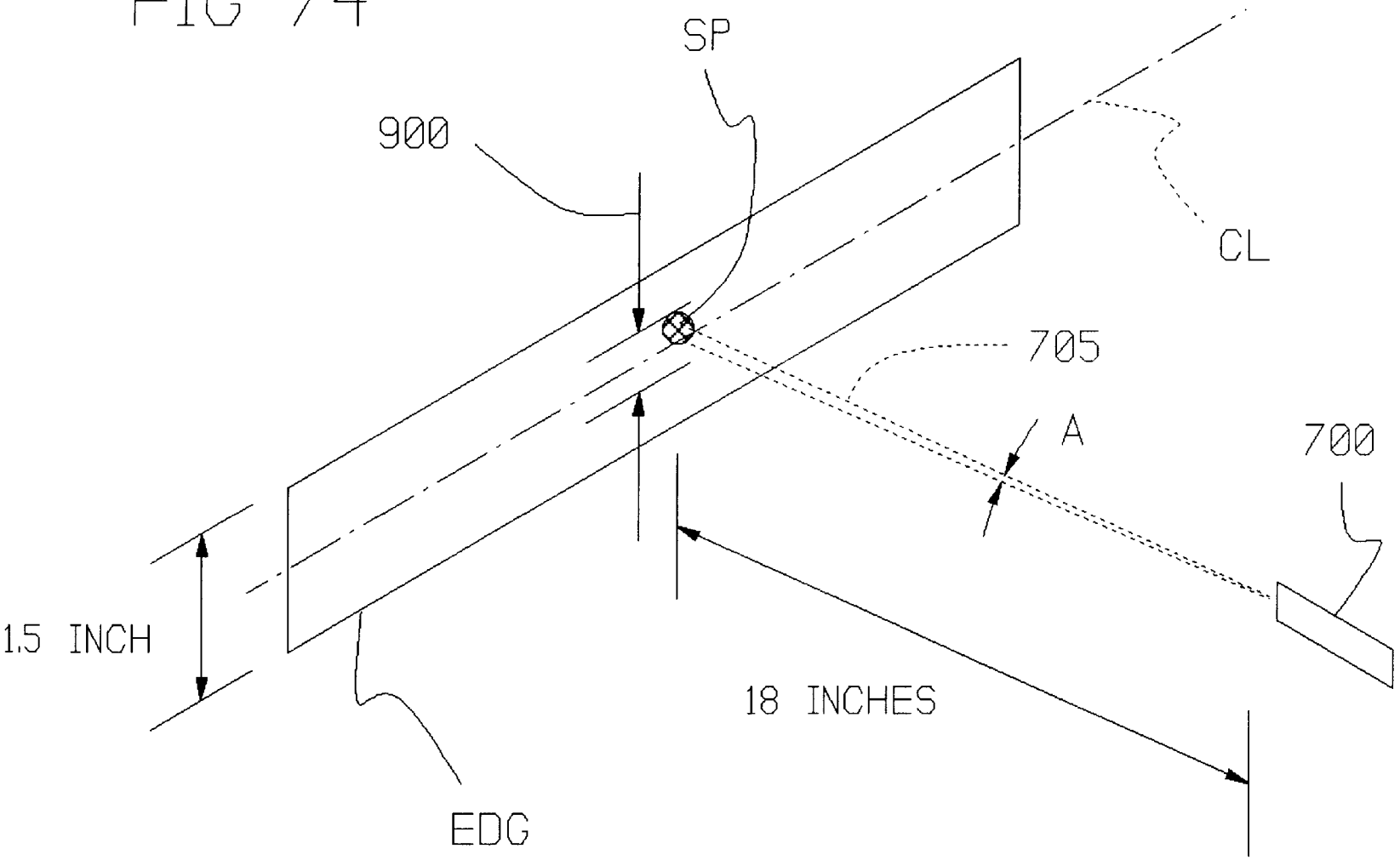
FIG. 74 illustrates a laser 700 projecting a spot SP, which deviates from ideal axis 705, and a range 900 indicating the allowable limits of deviation.

Preferably, the error bars EB are less than one inch tall, meaning that the maximum angle of deviation A in FIG. 74 cannot exceed 1.6 degrees.

Various situations can be envisioned, with wider framing members, and screw guns of different sizes. Consequently, the following maximum deviations in angle A are specifically covered: every tenth degree, ranging from 0.10 to 5.0 degrees. That is, the series 0.1, 0.2, 0.3 . . . 4.8, 4.9. 5.0 degrees is covered as the maximum allowable deviation in the laser beam from ideality.

Figure 78:
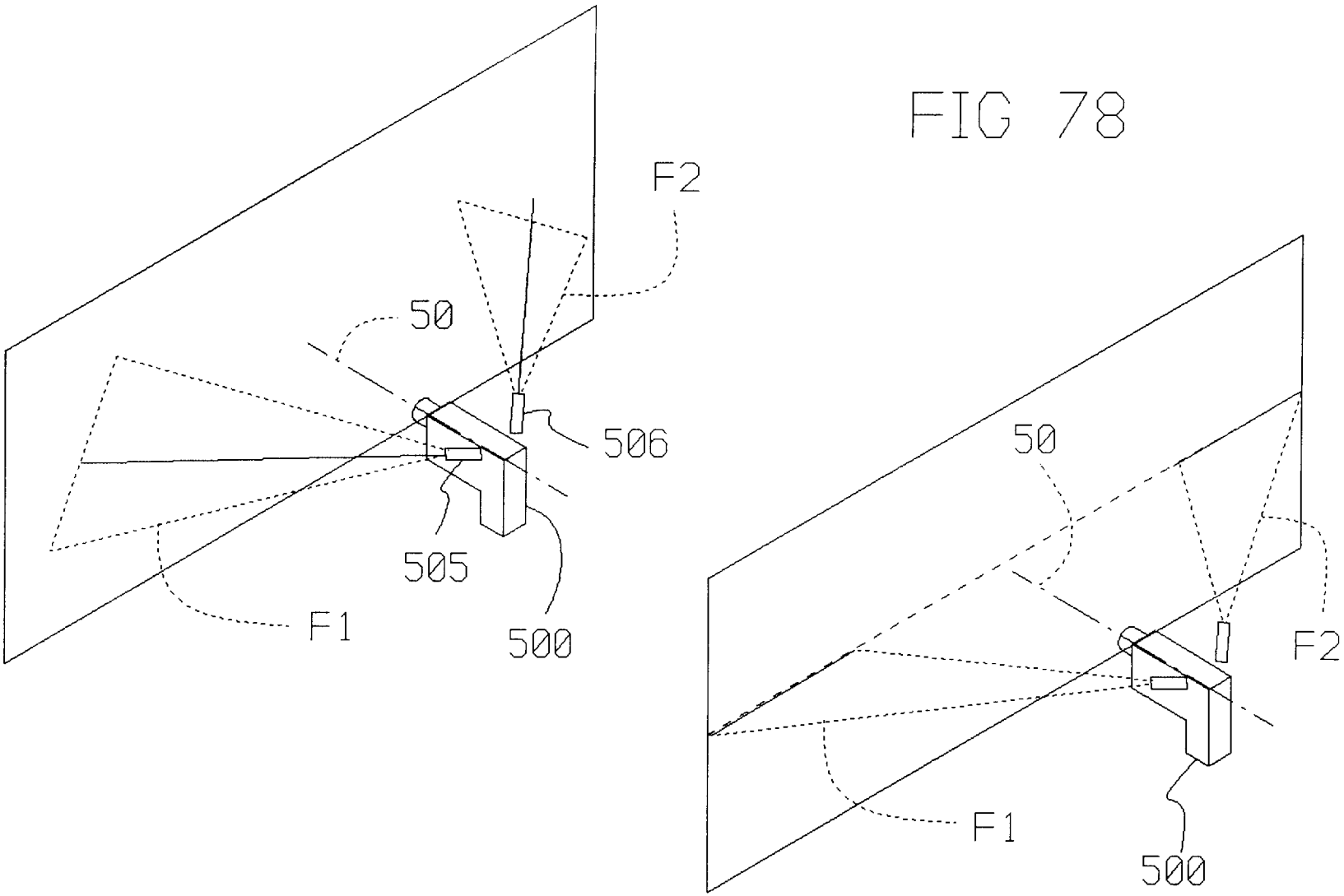
FIG. 78, left side, illustrates how fans F1 and F2 can be mis-aligned, and the right side illustrates alignment of the fans.

FIG. 78 illustrates the generalized situation which will occur during manufacture, or re-adjustment, of the lasers 505 and 506. In the general case, the fan-beams F1 and F2 will assume the positions shown on the left side of the Figure. They are neither co-planar with each other, nor with axis 50.

After adjustment, as by using an apparatus similar to that in FIG. 68, they will assume the positions shown on the right side of FIG. 78. The fans F1 and F2 are co-planar with each other, and with the axis 50, subject to the error represented by the angle A in FIG. 74. Preferably, angle A is zero, but manufacturing tolerances may not allow attainment of zero.

Applicant points out that, if a simple, non-fanned laser beam is used, the three-axis adjustment of FIG. 68 may not be required. That is, if the LINE of FIG. 69 is replaced by a dot (not shown), the dot can probably be centered on the target 710 by rotation of the laser 700 about two axes, such as yaw and pitch, and not three axes.

During manufacture of the invention, the lasers are oriented so that they produce the aligned fans shown on the right side of FIG. 78. However, it should be observed that the orientation steps need not occur when the lasers are installed in the screw gun 500. That is, for example, the lasers may be aligned at the time of their manufacture, in their own housings, so that they are aligned with their own coordinate system.

Then, they are installed into the gun 500, and their coordinate systems are aligned with that of the gun 500.

It is observed that the alignment process can be reversed, or repeated. For example, if a user drops the drywall screw gun 500, the lasers 700 may be knocked into misalignment. The alignment procedure may be repeated in this case. Further, the aligned lasers can be moved out of their proper orientation, if desired.

It is also observed that the plane of the laser beams, such as that of FIG. 60, need not be perpendicular to the handle of the screw gun. Further, in one embodiment, the important feature is that the two laser beams 510 and 511, together with the drill axis 50, be co-planar. This can be accomplished by (1) aligning one of the laser beams so that it lies in the same plane with the drill axis 50, at the appropriate angle AN in FIG. 57, and (2) aligning the other laser beam into that plane, at the appropriate angle AN1.

Numerous substitutions and modifications can be undertaken without departing from the true spirit and scope of the invention. What is desired to be secured by Letters Patent is the invention as defined in the following claims.

What is claimed is:

1. Apparatus, comprising:

a) a drywall screw gun (500), which includes a slip clutch, having a forward direction defined thereon, and having
   i) a chuck axis (50);
   ii) a handle (HH) having a handle-end (BE), which is displaced a distance DD of at least 3.0 inches from the chuck axis (50);

b) projection means, supported by the gun (500), for projecting two laser rays which follow two respective axes which intersect at a point, thereby defining a V, such that
   i) the chuck axis (50) is co-planar with the laser rays,
   ii) the chuck axis bisects the V, and
   iii) the vertex angle of the V is between 90 and 130 degrees.

2. Apparatus according to claim 1, wherein, when the chuck has a forward end which is located between 1.0 and 1.75 inches from a surface, and the chuck axis is perpendicular to the surface, the lasers project two spots onto that surface, over 46 inches apart.

3. Apparatus according to claim 1, wherein, at a time when the screw gun is located in an operative position, ready to drive a screw into a mid-field position of a sheet of drywall behind which lies a framing member, the two lasers project two spots onto the framing member which are over 48 inches apart.

4. A tool, comprising:

a) a drywall screw gun, comprising a chuck having a chuck axis and a slip clutch driving the chuck; and b) a projector supported by the gun for projecting two laser beams which follow two respective axes which intersect at a point, thereby defining a "V", wherein
   i) the vertex angle of the "V" lies between 90 and 130 degrees;
   ii) the chuck axis bisects the "V."

5. A tool, comprising:

a) a drywall screw gun, comprising
   i) a motor, and
   ii) a chuck, driven by the motor, for
      A) holding a screwdriver bit, and
      B) rotating the screwdriver bit about a chuck axis, and b) projection means, attached to the gun, for projecting
   i) a first laser beam left of the chuck axis, along a first optical axis which intersects the chuck axis at an angle AN, which lies between 45 and 65 degrees; and
   ii) a second laser beam right of the chuck axis, and co-planar with both the chuck axis and the first optical axis, the second laser beam following a second optical axis which intersects the chuck axis at an angle equal to AN.

6. Tool according to claim 5, and further comprising iii) a clutch interconnected between the motor and the chuck, which slips when load on the bit exceeds a threshold.

7. Tool according to claim 5, wherein the intersection points where the two optical axes intersect a surface lie between 40 inches and 60 inches apart, when the gun is positioned perpendicular to said surface, and operatively coupled to a drywall screw which contacts said surface.

8. Apparatus according to claim 1, wherein the projection means further projects (A) a first group of additional light rays, and (B) a second group of additional light rays, i) the first group accompanying one of the laser rays, and forming a first flat, fan-shaped beam; and ii) the second group accompanying the other laser ray, and forming a second flat fan-shaped beam.

9. Tool according to claim 4, wherein the projector further projects (A) a first group of additional light rays, and (B) a second group of additional light rays, i) the first group accompanying one of the laser beams, and forming a first flat, fan-shaped beam; and ii) the second group accompanying the other laser beam, and forming a second flat fan-shaped beam.

* * * * *